US008607923B2

(12) United States Patent
Takagaki et al.

(10) Patent No.: US 8,607,923 B2
(45) Date of Patent: Dec. 17, 2013

(54) EXHAUST APPARATUS OF INTERNAL COMBUSTION ENGINE

(75) Inventors: Nakaya Takagaki, Toyota (JP); Kazutoshi Wakatsuki, Toyota (JP); Hideyuki Komitsu, Toyota (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 0 days.

(21) Appl. No.: 13/517,198

(22) PCT Filed: Dec. 28, 2009

(86) PCT No.: PCT/JP2009/007324
§ 371 (c)(1),
(2), (4) Date: Jun. 19, 2012

(87) PCT Pub. No.: WO2011/080793
PCT Pub. Date: Jul. 7, 2011

(65) Prior Publication Data
US 2012/0273302 A1 Nov. 1, 2012

(51) Int. Cl.
*F01N 1/00* (2006.01)
*F01N 1/02* (2006.01)
*F01N 13/08* (2010.01)

(52) U.S. Cl.
USPC ..... 181/249; 181/227; 181/228; 181/250; 181/255; 60/324

(58) Field of Classification Search
USPC ..... 181/249, 227, 228, 250, 255; 60/324
See application file for complete search history.

(56) References Cited

U.S. PATENT DOCUMENTS

| | | | | |
|---|---|---|---|---|
| 4,102,430 | A * | 7/1978 | Wilson | 181/265 |
| 6,588,545 | B1 * | 7/2003 | Lee | 181/264 |
| 2005/0126850 | A1 * | 6/2005 | Yamaguchi et al. | 181/249 |
| 2010/0126799 | A1 * | 5/2010 | Matsueda et al. | 181/271 |
| 2012/0137666 | A1 * | 6/2012 | Komitsu et al. | 60/324 |
| 2012/0138384 | A1 * | 6/2012 | Wakatsuki | 181/227 |
| 2012/0168245 | A1 * | 7/2012 | Wakatsuki et al. | 181/228 |
| 2012/0180465 | A1 * | 7/2012 | Takagaki et al. | 60/324 |

FOREIGN PATENT DOCUMENTS

| | | | |
|---|---|---|---|
| JP | U-54-143941 | * | 10/1979 |
| JP | U-55-17956 | | 2/1980 |
| JP | U-59-32111 | | 2/1984 |
| JP | U-61-142114 | | 9/1986 |
| JP | Y2-2-18260 | * | 5/1990 |
| JP | A-3-67012 | | 3/1991 |
| JP | H09-304084 | A | 11/1997 |
| JP | H10-30424 | | 2/1998 |
| JP | A-2005-256736 | | 9/2005 |
| JP | A-2006-46121 | | 2/2006 |
| JP | A-2009-236040 | | 10/2009 |
| JP | A-2010-228499 | | 10/2010 |

OTHER PUBLICATIONS

International Search Report issued in International Patent Application No. PCT/JP2009/007324 dated Mar. 16, 2010 (with translation).

* cited by examiner

*Primary Examiner* — David Warren
*Assistant Examiner* — Christina Russell
(74) *Attorney, Agent, or Firm* — Oliff & Berridge, PLC

(57) ABSTRACT

An exhaust apparatus for internal combustion engines which can reduce exhaust noises, its weight and production cost with no need to provide a sub-muffler. The exhaust apparatus is provided with an inner pipe having the upstream open end and the downstream open end is disposed in the tail pipe, and the upstream open end of the inner pipe is protruded outwardly from the inside of the tail pipe to be extended into the resonance chamber, and thus the upstream open end is closed by the resonance chamber defined by the outer shell of the muffler, the end plate, and the partition plate.

5 Claims, 15 Drawing Sheets

SPEAKER VIBRATION TEST RESULT

EXHAUST APPARATUS OF INTERNAL COMBUSTION ENGINE

TECHNICAL FIELD

This invention relates to an exhaust apparatus of an internal combustion engine, and in particularly to an exhaust apparatus of an internal combustion engine for reducing exhaust gas sounds caused by an air column resonance of an exhaust pipe provided at the most downstream side in the discharging direction of an exhaust gas flow.

BACKGROUND ART

As an exhaust apparatus of an internal combustion engine to be used by an automotive vehicle, there has so far been known an exhaust apparatus as shown in FIG. 18 (for example see Patent Document 1). In FIG. 18, the known exhaust apparatus 4 is constructed to allow an exhaust gas to be introduced therein, after the exhaust gas is exhausted from an engine 1 serving as an internal combustion engine and then passes through an exhaust manifold 2 and a catalytic converter 3 where the exhaust gas is purified.

The exhaust apparatus 4 is constituted by a front pipe 5 connected to the catalytic converter 3, a center pipe 6 connected to the front pipe 5, a main muffler 7 connected to the center pipe 6 and serving as a sound deadening device, a tail pipe 8 connected to the main muffler 7, and a sub-muffler 9 interposed to the tail pipe 8.

As shown in FIG. 19, the main muffler 7 has an expansion chamber 7*a* for introducing therein through small through bores 6*a* formed in the center pipe 6 to expand the exhaust gas to mute the sounds of the exhaust gas, and a resonance chamber 7*b* allowing a downstream open end 6*b* of the center pipe 6 to be received therein. The sound of the exhaust gas introduced into the resonance chamber 7*b* from the downstream open end 6*b* of the center pipe 6 has a specified frequency, and thus can be muted by the Helmholtz resonance.

It is here assumed that the length of the center pipe 6 projecting into the resonance chamber 7*b* from the small through bores 6*a* is $L_1$, and the cross section area of the center pipe 6 is S, the volume of the resonance chamber 7*b* is V, and the sound speed in the air is C. At this time, the resonance frequency fn in the air can be obtained by the following equation (1) based on the Helmholtz resonance.

$$f_n = \frac{c}{2\pi}\sqrt{\frac{S}{V \cdot L_1}} \tag{1}$$

As clearly understood from the above equation, the resonance chamber is designed to enable its resonance frequency to be tuned to the low frequency side by increasing the volume V of the resonance chamber 7*b* or otherwise by lengthening the length $L_1$ of the center pipe 6 projecting into the resonance chamber 7*b*, while enabling its resonance frequency to be tuned to the high frequency side by decreasing the volume V of the resonance chamber 7*b* or otherwise by shortening the length $L_1$ of the center pipe 6 projecting into the resonance chamber 7*b*.

The sub-muffler 9 is adapted to suppress the sound pressure level of the air column resonance from being increased when the air column resonance is generated in response to the pipe length of the tail pipe 8 in the tail pipe 8 by the pulsation of the exhaust gas during the operation of the engine 1.

In general, the pipe having an upstream open end and a downstream open end at the respective upstream and downstream sides of the exhaustion direction of the exhaust gas is subjected to incident waves caused by the pulsation of the exhaust gas during the operation of the engine 1 at the upstream open end and the downstream open end, thereby generating an air column resonance. The air column resonance has a frequency corresponding to a half wavelength equal to the pipe length of the tail pipe as a basic component, and thus has wavelengths obtained by multiplying the half wavelength by natural numbers.

For example, taking an example in which the tail pipe 8 having no sub-muffler 9 extends backwardly from the main muffler 7, as shown in FIG. 18, the wavelength λ1 of the air column resonance of a basic vibration (primary component) is roughly double the pipe length L of the tail pipe 8, while the wavelength λ2 of the air column resonance of the secondary component is roughly one time the pipe length L of the tail pipe 8 as shown in FIG. 20. The wavelength λ3 of the air column resonance of the third component is ⅔ times the pipe length L of the tail pipe 8. Therefore, the tail pipe 8 has therein standing waves having respective nodes of sound pressures at the upstream open end 8*a* and the downstream open end 8*b*.

The frequency of the air column resonance "fc" can be represented by the following equation (2).

$$fc=(c/2L)\cdot n \tag{2}$$

c: sound speed, L: pipe length of tail pipe, n: degree

As it is obvious from the above equation (2), it is known that the longer the pipe length L of the tail pipe 8, the more the air column resonance frequency "fc" is transferred to the low frequency area, thereby causing the exhaust gas sounds to be increased at the low rotation time of the engine 1, and thereby causing exhaust gas noises to be deteriorated and giving unpleasant feelings to a driver.

In particular, as shown in FIG. 21, when the primary component f1 and the secondary component f2 of the air column resonance are generated in the normal rotation area of the engine 1, there is generated unpleasant noises called muffled sounds which are a cause for the exhaust gas noises to be deteriorated.

For this reason, in the case of the pipe length of the tail pipe 8 being long, the sub-muffler 9 smaller in capacity than the main muffler 7 is provided at the optimum position among the abdominal portion of the standing wave high in the sound pressure level, and the respective abdominal portions of the primary component f1 and the secondary component f2 of the exhaust gas sounds caused by the air column resonance, so that the exhaust gas noises are suppressed in the normal rotation area of the engine 1 to prevent the unpleasant feeling from being given to the driver.

On the other hand, it may be considered that the exhaust apparatus 4 is provided with no sub-muffler 9 to reduce its production cost and its weight, however, no sub-muffler 9 provided on the exhaust apparatus 4 leads to lengthening the length of the tail pipe 8, and thus to the frequency of the air column resonance of the tail pipe 8 moving toward the low frequency side.

In this case, it may be considered that the frequency of the air column resonance of the resonance chamber 7*b* of the main muffler 7 connected with the upstream open end 8*a* of the tail pipe 8 is tuned to the frequency of the air column resonance of the tail pipe 8, thereby muting the air column resonance of the tail pipe 8 in the resonance chamber 7*b* of the main muffler 7.

More specifically, it may be considered that in accordance with the equation (1), the resonance chamber is designed to enable the resonance frequency of the resonance chamber 7*b* to be tuned to the low frequency side by increasing the volume V of the resonance chamber 7*b* or otherwise by lengthening the length $L_1$ of the center pipe 6 projecting into the resonance chamber 7*b*, thereby preliminarily muting the air column resonance generated in the tail pipe 8 in the resonance chamber 7*b*.

CITATION LIST

Patent Literature

{PTL1}
Patent Document 1: Japanese Patent Application Publication No. 2006-046121

SUMMARY OF INVENTION

Technical Problem

However, the conventional exhaust apparatus encounters such a problem that the case of preliminarily muting the air column resonance generated in the tail pipe 8 in the resonance chamber 7*b* by using the Helmholtz resonance is apt to result in the fact that the sounds generated by the repeated reflections of the standing waves caused in the tail pipe 8 are discharged from the downstream open end 8*b* of the tail pipe 8. Because the resonance chamber 7*b* is spaced apart from the upstream open end 8*a* of the tail pipe 8 even if the preliminarily muting is performed by the air column resonance. This means that the Helmholtz resonance in the resonance chamber 7*b* is in reality difficult to effectively affect the air column resonance generated in the tail pipe 8, thereby making it impossible to sufficiently suppress the resonance air column.

Further, at the deceleration time of the vehicle, the accelerator pedal is released to have the throttle valves closed. For this reason, the flow amount of the exhaust gas to be discharged from the engine 1 to the exhaust apparatus 4 is abruptly decreased leaving a small pressure of air introduced into the resonance chamber 7*b*.

This makes it impossible to obtain a sufficient amount of air to achieve the Helmholtz resonance in the resonance chamber 7*b*, thereby leading to difficulties in suppressing the air column resonance in the tail pipe 8. At the deceleration time of the vehicle, the rotation speed of the engine 1 is abruptly decreased, there is caused muffled sounds in the vehicle cabin at the low rotation speed of the engine 1, for example, approximately 2000 rpm (the primary component f1 of the exhaust sounds by the air column resonance), thereby resulting in giving unpleasant feelings to the driver.

It is therefore required to provide the sub-muffler 9 in the tail pipe in order to effectively suppress the air column resonance, thereby resulting not only in increasing the weight of the exhaust apparatus 4 only with the sub-muffler 9 provided but also in increasing the production cost of the exhaust apparatus 4.

The present invention has been made for solving the conventional problems encountered by the conventional exhaust apparatuses, and it is therefore an object of the present invention to provide an exhaust apparatus of an internal combustion engine which is constructed with no sub-muffler required for the conventional exhaust apparatus, and is capable of reducing the exhaust gas noises, decreasing the weight of the exhaust apparatus, and decreasing the production cost of the exhaust apparatus.

Solution to Problem

To achieve the above object, the exhaust pipe part according to the present invention, (1) comprises: a sound deadening device having a resonance chamber to mute exhaust gas sounds of a specific frequency, an exhaust pipe having at its one end portion an upstream open end connected with the sound deadening device at the upstream side of exhaust gas flow in the exhaust gas flow direction, and at its other end potion a downstream open end through which the exhaust gas discharged from the sound deadening device is discharged to the atmosphere at the downstream side of exhaust gas flow in the exhaust gas flow direction, and a hollow member disposed in the exhaust pipe and having a downstream end forming an open end, and an upstream end protruded outwardly from the inside of the exhaust pipe communicating with the resonance chamber and being closed by the wall portion of the sound deadening device defining the resonance chamber.

The exhaust gas pipe provided with a hollow member therein is constituted with an open end at the downstream end, and the upstream end protruded outwardly from the inside of the exhaust gas pipe communicating with the resonance chamber, so that the upstream end is closed by the wall portion of the sound deadening device defining the resonance chamber. As a result, it is possible to generate a pressure energy of the exhaust flow in the exhaust pipe, i.e., the pressure distribution of the pressure energy of the air in the hollow member and the resonance chamber, and accumulate the pressure energy in the hollow member and the resonance chamber, so that the pressure energy is retained in the hollow member and the resonance chamber, and not released to the outside at the time of the air column resonance.

The accumulation of the pressure energy of the air in the hollow member and the resonance chamber is executed by the pressure energy of the air in the exhaust gas pipe, and the total pressure energy in the whole exhaust gas pipe is not changed. Therefore, the pressure energy in the exhaust gas pipe is distributed to the pressure energy in the hollow member and the resonance chamber, and the pressure energy of the exhaust gas pipe except the hollow member and the resonance chamber, thereby discharging outside only the pressure energy of the exhaust gas pipe except the hollow member and the resonance chamber.

As the hollow member and the resonance chamber are large in capacity to accumulate the pressure energy, it is possible to reduce drastically the pressure energy discharged from the exhaust gas pipe. Therefore it is possible to lower the peak of the sound pressure and reduce the level of the sound pressure at the time of the air column resonance, thereby reducing the exhaust noises.

A sound wave by exhaust pulsation repeats the reflection at the open end, so that a standing wave is generated in the exhaust gas pipe at the time of the air column resonance. When the length of the exhaust gas pipe is in specific relationship with the wavelength of the standing wave, the amplitude of the standing wave increases remarkably and the air column resonance occurs.

In the present invention, as the hollow member is disposed in the exhaust pipe and having a downstream open end forming an open end at the downstream side of the exhaust gas pipe, and an upstream end being closed by the resonance chamber, the hollow member and the resonance chamber can be in face-to-face relationship with each other in the direction of propagation of the sound waves and the downstream open end of the hollow member can be placed at the generation portion of the air column resonance.

As a result, it is possible to make the hollow member and the resonance chamber a Helmholtz resonance chamber serving as the sound source of the air column resonance, and suppress the air column resonance by matching the resonance frequency of the resonance chamber to the air column resonance frequency of the exhausted gas pipe.

As the downstream portion of the hollow member can be placed at the generation portion of the air column resonance, it is possible to sufficiently suppress the air column resonance even if the exhaust gas flow introduced into the muffler is drastically decreased at the time of the deceleration of the vehicle.

In this way, it is possible to reduce the sound pressure itself of the exhaust gas, thereby making it is possible to reduce the sound pressure in all of the operation areas not only at the time of the air column resonance but also at the time of other than the air column resonance, and to further suppress the air column resonance by the Helmholtz resonance in addition to the reduction of the sound pressure at the time of the air column resonance For this reason, it is possible to drastically reduce the exhaust noises.

As a consequence, it is possible to eliminate a sub-muffler used in the conventional exhaust apparatus and make small in size a sound deadening device provided in the upstream portion of an exhaust gas pipe. In addition, the exhaust apparatus according to the present invention can reduce the weight of the exhaust apparatus and the production cost of the exhaust apparatus.

In the exhaust pipe part according to the present invention as set forth in the above item (1), (2) which the axial lengths of the exhaust pipe and the hollow member are set to have the frequency of the air column resonance generated in the exhaust pipe matched to the specific frequency of the resonance chamber.

In the exhaust apparatus according to the present invention, the length in the axial direction of the above exhaust pipe and the length in the axial direction of the above hollow member are set so that the frequency of the air column resonance generated in the above exhaust pipe can be matched to the above specific frequency of the above resonance chamber, thereby making it is possible to suppress further the air column resonance by the Helmholtz resonance.

Further, it is possible to tune the resonance frequency of the resonance chamber to the lower frequency side by lengthening the hollow member, thereby making it is possible to suppress the sound pressure level of the air column resonance of the first component and the second component of the air column resonance frequency in the normal rotation area of the internal combustion engine, and prevent the unpleasant feelings from being given to the driver by reducing exhaust noises.

In the exhaust pipe part according to the present invention as set forth in the above item (1) or (2), (3) which the downstream end of the hollow member is positioned at the upstream side of the central portion of the exhaust pipe in the longitudinal direction of the exhaust pipe.

In the exhaust apparatus according to the present invention, the downstream end of the hollow member is positioned on the upstream side than the center of the axial length of the exhaust pipe, thereby making it possible to position the downstream end of the hollow member in the high sound pressure area of the air column resonance, e.g., at the abdominal (antinode) portion or close to the abdominal portion of the standing wave of the air column resonance, and to further suppress the air column resonance by the Helmholtz resonance.

In the exhaust pipe part according to the present invention as set forth in the above items (1) to (3), (4) the exhaust pipe is constituted by a single tail pipe received in the sound deadening device at the upstream portion, the hollow member having an upstream portion supported by the inner peripheral portion of the wall portion of the resonance chamber, and a downstream portion having a circumferential portion partially supported by the inner peripheral portion of the exhaust pipe.

In the exhaust apparatus according to the present invention, the exhaust pipe is constituted by a single tail pipe received in the sound deadening device at the upstream portion, the hollow member having an upstream outer peripheral portion supported by the inner peripheral portion of the wall portion of the resonance chamber, and a downstream portion having a circumferential portion partially supported by the inner peripheral portion of the exhaust pipe, thereby making it possible to support the hollow member at the both of the upstream portion and downstream portion by the wall portion of the resonance chamber and the tail pipe respectively, and fix the hollow member to the tail pipe securely.

In the exhaust pipe part according to the present invention as set forth in the above items (1) to (3), (5) the exhaust pipe is constituted by an outer pipe provided in the sound deadening device, and a tail pipe connected to the outer pipe and extending toward the downstream side of the sound deadening device, and the hollow member is constituted by an outlet pipe provided in the outer pipe, the downstream portion of the outlet pipe is connected with the upstream portion of the tail pipe, and is formed with at least one through bore allowing the inside of the outlet pipe to be held in communication with the inside of the outer pipe.

In the exhaust apparatus according to the present invention, the hollow member is constituted by an existing outlet pipe, and an outer pipe fixed to the outlet pipe at the outer peripheral portion, and the downstream portion of the outlet pipe has a through bore allowing the inside of the outlet pipe to be held in communication with the inside of the outer pipe, thereby make it possible to discharge the exhaust gas to the tail pipe through the through bore of the outlet pipe from a passage defined by the outer peripheral portion of the outlet pipe and the inner peripheral portion of the outer pipe.

Further, it is possible to suppress the sound pressure itself of the exhaust gas by using an existing outlet pipe for the sound deadening device, thereby making it possible to reduce the sound pressure in all of the operation areas not only at the time of the air column resonance but also at the time of other than the air column resonance, and to further suppress the air column resonance using the Helmholtz resonance in addition to the reduction of the sound pressure at the time of the air column resonance. For this reason, it is possible to suppress the production cost of the sound deadening device and the exhaust apparatus from being increased.

In the exhaust pipe part according to the present invention as set forth in the above items (5), (6) which the outer pipe and the outlet pipe are bent in the sound deadening device. In the exhaust apparatus according to the present invention, the outer pipe and the outlet pipe are bent in the sound deadening device, thereby making it possible to lengthen the outer pipe and the outlet pipe in the sound deadening device, and tune the resonance frequency of the resonance chamber to the low frequency side by shortening the axial length of the sound deadening device.

Advantageous Effects of Invention

The present invention can provide an exhaust apparatus of an internal combustion engine which does not require a conventionally used sub-muffler supported on the tail pipe, and which can suppress the exhaust noises from being increased, and reduce the weight and the production cost of the exhaust apparatus.

DESCRIPTION OF EMBODIMENTS

The embodiment of the exhaust apparatus for the internal combustion engine according to the present invention will be described hereinafter with reference to the accompanying drawings.

(First Embodiment)

Figure 1:
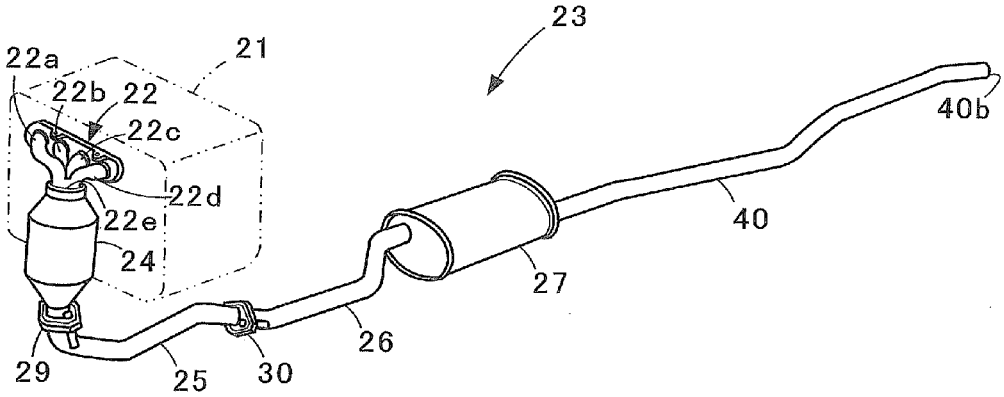
FIG. 1 shows a view of a first embodiment of an exhaust apparatus of an internal combustion engine according to the present invention, and is a framework of the exhaust apparatus of an internal combustion engine.

FIGS. 1 to 13 are views respectively showing a first embodiment of the exhaust apparatus for the internal combustion engine according to the present invention. The construction of the first embodiment will firstly be explained. As shown in FIG. 1, for example, an exhaust gas manifold 22 is connected to an engine 21 serving as a straight 4-cylinder internal combustion engine, and an exhaust apparatus 23 is connected to the exhaust gas manifold 22.

The engine 21 is not limited to the straight 4-cylinder internal combustion engine, but may be constituted by a straight 3-cylinder internal combustion engine or a straight more than 4-cylinder internal combustion engine. The engine 21 may be a V-type engine having more than two cylinders respectively mounted on the banks divided right and left.

The exhaust gas manifold 22 is constituted by four exhaust gas branch pipes 22*a*, 22*b*, 22*c*, 22*d* respectively connected to exhaust ports formed to be held in communication with the first to fourth cylinders of the engine 21, and an exhaust gas collecting pipe 22*e* constructed to collect the downstream sides of the exhaust gas branch pipes 22*a*, 22*b*, 22*c*, 22*d*, so that the exhaust gas discharged from the cylinders of the engine 21 can be introduced into the exhaust gas collecting pipe 22*e* through the exhaust gas branch pipes 22*a*, 22*b*, 22*c*, 22*d*.

The exhaust apparatus 23 is provided with a catalytic converter 24, a cylindrical front pipe 25, a cylindrical center pipe 26, a muffler 27 serving as a sound deadening device, and a single tail pipe 40 serving as an exhaust gas pipe. The exhaust apparatus 23 is installed at the downstream side of the exhaust gas discharging direction of the engine 21 in such a manner that the exhaust apparatus 23 is resiliently hanging from the floor of the vehicle. The term "upstream side" indicates an upstream side in the discharging direction of the exhaust gas, while the term "downstream side" indicates a downstream side in the discharging direction of the exhaust gas.

The upstream end of the catalytic converter 24 is connected to the downstream end of the exhaust gas collecting pipe 22*e*, while the downstream end of the catalytic converter 24 is connected to the front pipe 25. The catalytic converter 24 is constructed by a case housing therein a honeycomb substrate or a granular activated alumina-made carrier deposited with catalysts such as platinum and palladium to perform reduction of Nox, and oxidization of CO, HC. The upstream end of the center pipe 26 is connected to the downstream end of the front pipe 25, while the downstream end of center pipe 26 is connected to the muffler 27 for deadening the exhaust gas sound.

Figure 2:
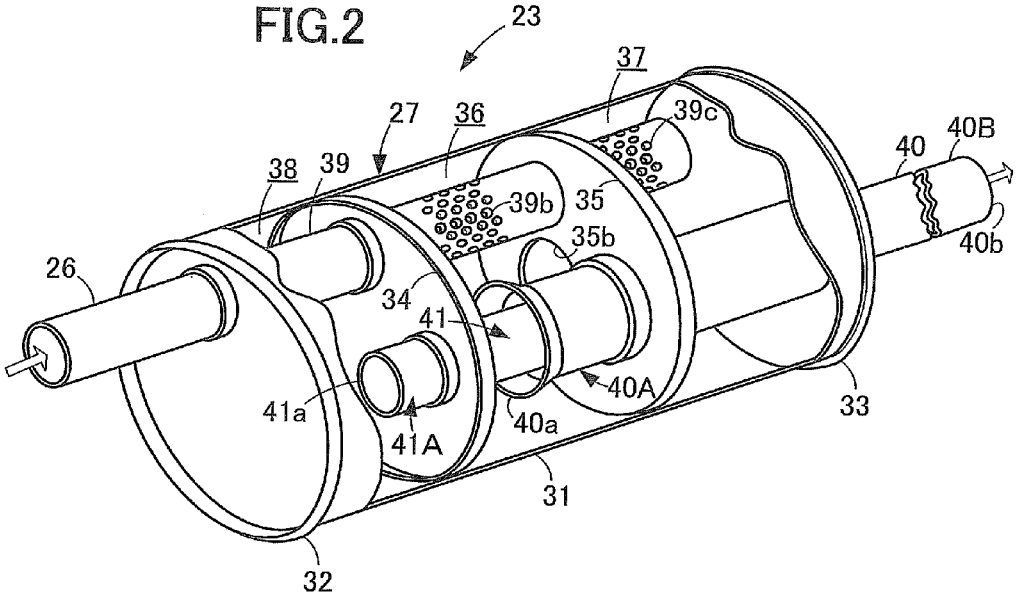
FIG. 2 shows a view of the first embodiment of the exhaust apparatus of an internal combustion engine according to the present invention, and is a perspective cross-sectional view of a sound deadening device.
Figure 3:
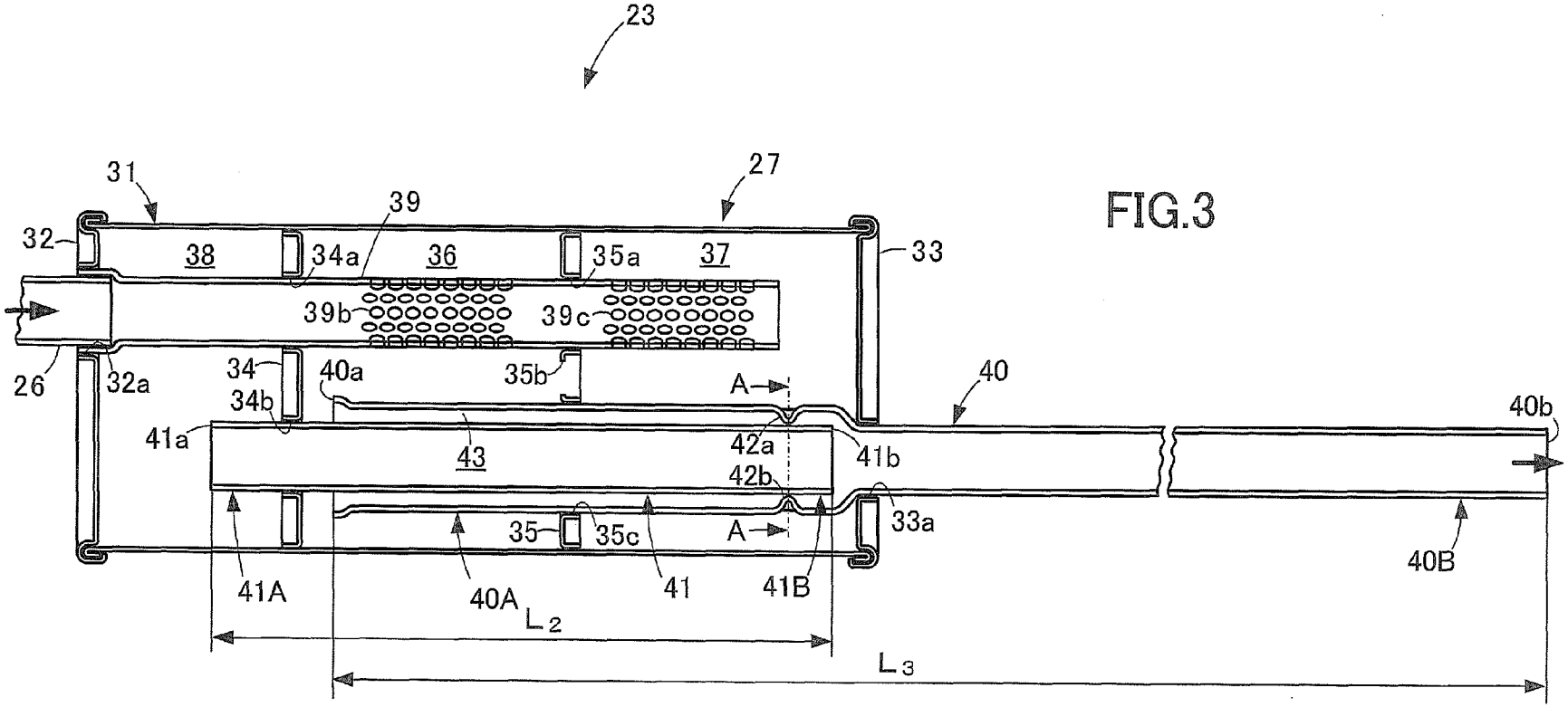
FIG. 3 shows a view of the first embodiment of the exhaust apparatus of the internal combustion engine according to the present invention, and is a cross-sectional view of a sound deadening device with an inlet pipe and a tail pipe being cross-sectioned.

As shown in FIGS. 2 and 3, the muffler 27 is provided with an outer shell 31 formed in a cylindrical shape, and end plates 32, 33 for closing the both ends of the outer shell 31. The outer shell 31 is provided therein with partition plates 34, 35 which are adapted to divide the outer shell 31 into the expansion chambers 36, 37 for expanding the exhaust gas to deaden the exhaust gas sound, and a resonance chamber 38 for muting the exhaust gas sound with a specific frequency by the Helmholtz resonance.

The end plate 32, the partition plate 34, and the partition plate 35 are formed with through bores 32*a*, 34*a*, and 35*a* respectively. The through bores 32*a*, 34*a*, and 35*a* allow the inlet pipe 39 connected to the downstream portion of the center pipe 26 to pass therethrough.

The inlet pipe 39 is supported on the end plate 32, the partition plate 34, and the partition plate 35 to be accommodated in the expansion chambers 36, 37 and the resonance chamber 38.

The inlet pipe 39 is formed with a plurality of small through bores 39*b*, 39*c* formed to be arranged in the axial direction (the discharging direction of the exhaust flow) and the circumferential direction of the inlet pipe 39, so that the inner chamber of the inlet pipe 39 is held in communication with the expansion chambers 36, 37 through the small through bores 39*b*, 39*c*. The partition plate 35 is formed with a through bore 35*b* having the expansion chamber 36 held in communication with the expansion chamber 37.

Therefore, the exhaust gas to be introduced into the muffler 27 through the inlet pipe 39 from the center pipe 26 is introduced into the expansion chambers 36, 37 through the through bores 39*b*, 39*c*.

The end plate 33, the partition plate 34, and the partition plate 35 are formed with through bores 34*b*, 35*c*, and 33*a* respectively. The through bores 35*c* and 33*a* allow the upstream portion 40A of the tail pipe 40 to pass therethrough.

The upstream portion 40A of the tail pipe 40 is provided at its upstream end with an upstream open end 40*a*. The upstream portion 40A of the tail pipe 40 is passed through the through bores 35*c*, 33*a* with the upstream open end 40*a* being opened to the expansion chamber 36 to be connected with the muffler 27 and supported by the partition plate 35 and the end plate 33.

The downstream portion 40B of the tail pipe 40 is formed at its downstream end with a downstream open end 40*b* held in communication with the atmosphere. This means that the exhaust gas introduced into the upstream open end 40*a* of the tail pipe 40 from the expansion chambers 36, 37 of the muffler 27 is discharged to the atmosphere from the downstream open end 40*b* through the tail pipe 40.

In other words, the tail pipe 40 according to the present embodiment has an upstream portion 40A, and a downstream portion 40B. The upstream portion 40A has an upstream open end 40*a* connected with the muffler 27 at the upstream side in the exhaust gas direction of the exhaust gas discharged from the engine 21, while the downstream portion 40B has a downstream open end 40*b* for discharging the exhaust gas to the atmosphere.

Here, the upstream portion 40A and the downstream portion 40B of the tail pipe 40 are indicative of portions upstream and downstream of the tail pipe 40 and including the upstream open end 40*a* and the downstream open end 40*b* and having a predetermined length.

At the upstream portion 41A of the tail pipe 40 accommodated in the expansion chambers 36, 37 is disposed an inner pipe 41 constituting a hollow member defined in the present invention. The inner pipe 41 has an open end opened inside of the tail pipe 40 at the downstream end, and has an open end at the upstream end. The downstream end is hereinafter referred to as a downstream open end 41*b* and the upstream end is hereinafter referred to as an upstream open end 41*a*.

The inner pipe 41 has an inner space held in communication with the resonance chamber 38 by protruding the upstream open end 41*a* outwardly from the inside of the tail pipe 40. The upstream portion 41A is supported by the partition plate 34 by being received in the through bore 34*b* of the partition plate 34. Therefore, the upstream open end 41*a* of the inner pipe 41 is closed by the wall portion of the sound deadening device. The wall portion of the sound deadening device defining the resonance chamber 38 is constituted by the outer shell 31, the end plate 32, and the partition plate 34.

Figure 4:
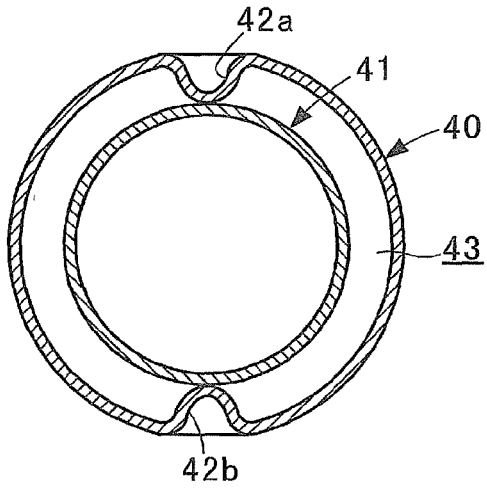
FIG. 4 is a cross-sectional view taken along and seen from the line A-A in FIG. 3.

The outer peripheral portion of the downstream portion 41B of the inner pipe 41 is supported by the tail pipe 40. More specifically, as shown in FIG. 4, the upper portion and the lower portion of the tail pipe 40 are respectively formed with projecting portions 42*a* and 42*b* projected toward the inner pipe 41, and the inner pipe 41 is supported at the inner peripheral portion of the tail pipe 40 by the projecting portions 42*a* and 42*b*. For this reason, the inner pipe 41 is supported at both of the upstream portion 41A and the downstream portion 41B by the partition plate 34 and the tail pipe 40, respectively. In addition, the projecting portions 42*a*, 42*b* are formed only at the upper portion and the lower portion of the tail pipe 40 to suppress the increase of the back pressure of the exhaust flow passing through the passage 43 between the inner peripheral portion of the tail pipe 40 and the outer peripheral portion of the inner pipe 41.

If the length of the inner pipe 41 is represented by $L_2$, the cross-sectional area of the inner pipe 41 is represented by S, the volume of the resonance chamber 38 is represented by V, and the speed of sound in the air is represented by c, the resonance frequency $f_n$ in the air can be given by the following equation in accordance with the Helmholtz resonance.

$$f_n = \frac{c}{2\pi}\sqrt{\frac{S}{V \cdot L_2}} \tag{3}$$

Therefore, the exhaust gas introduced into the resonance chamber 38 is muted at the specific frequency by the Helmholtz resonance. More specifically, the fact that the volume V of the resonance chamber 38 is made large, or the length $L_2$ of the inner pipe 41 connected to the resonance chamber 38 is made long makes it possible to tune the resonance frequency toward its low frequency side. On the other hand, the fact that the volume V of the resonance chamber 38 is made small, or the length $L_2$ of the inner pipe 41 connected to the resonance chamber 38 is made short makes it possible to tune the resonance frequency toward its high frequency side.

In the present embodiment, the resonance frequency of the resonance chamber 38 is tuned toward its low frequency side by lengthening the inner pipe 41. The resonance frequency of the resonance chamber 38 can be tuned toward its low frequency side by making small the volume of the resonance chamber 38 by lengthening the inner pipe 41, thereby making it possible to reduce the size of the muffler 27.

In the present embodiment, the axial length of the tail pipe 40 and the axial length of the inner pipe 41 are set to match the resonance frequency of the chamber 38 to the frequency of the air column resonance generated in the tail pipe 40.

In the case the air column resonance is generated at the normal rotation area in which the frequency of the air column resonance of the engine 21 is low, the tail pipe 40 is lengthened, it is necessary to lower the resonance frequency of the resonance chamber 38 to give rise to the resonance effect to the air column resonance generated in the tail pipe 40.

It will be understood from the equation (3) that the length of the inner pipe 41 and the volume of the resonance chamber 38 are in a definite relationship with the Helmholtz resonance. In the present embodiment, the length of the inner pipe 41 is set to match the resonance frequency of the resonance chamber 38 to the frequency of the air column resonance generated in the tail pipe 40 for making small the size of the resonance chamber 38.

Here, the explanation of the air column resonance will be made hereinafter. The standing wave of the air column resonance generated in the tail pipe 40 becomes remarkably large in amplitude and generates the air column resonance, when the length $L_3$ (see FIG. 3) of the tail pipe 40 is in a specific relationship with the wavelength λ of the standing wave. The air column resonance has a frequency corresponding to the half wavelength which is equal to the length $L_3$ of the tail pipe 40 as a basic frequency, and increases the sound pressure by generating the air column resonance which has wavelengths obtained by multiplying the half wavelength by natural numbers.

Figure 5:
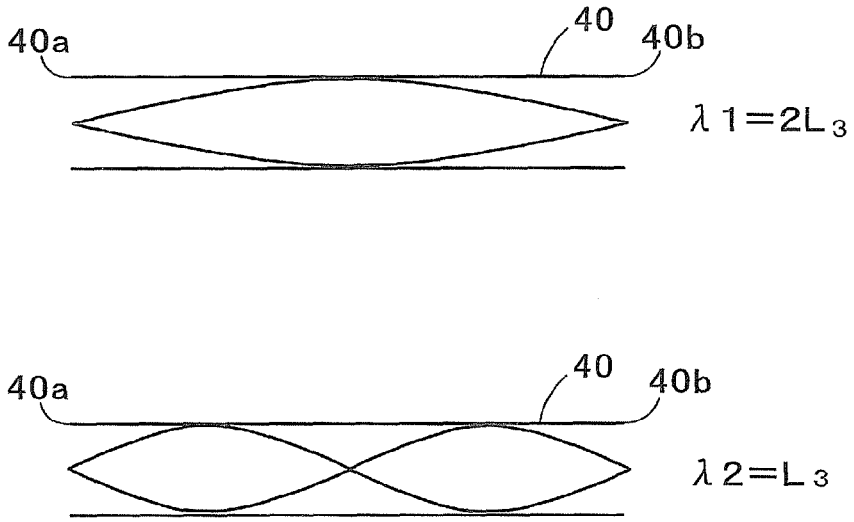
FIG. 5 shows a view of the first embodiment of the exhaust apparatus of an internal combustion engine according to the present invention, and is a view for explaining standing waves in sound pressure distributions of air column resonances caused by an open end reflection generated in the tail pipe.

More specifically, according to the pressure distribution of the standing wave of the air column resonance generated in the tail pipe 40 as shown in FIG. 5, the wavelength λ1 of the air column resonance of the fundamental vibration (primary component) is about two times of the length $L_3$ of the tail pipe 40, and the wavelength λ2 of the air column resonance of the secondary component is about one time of the length $L_3$ of the tail pipe 40.

As will be seen from FIG. 5, each standing wave has nodes of the sound pressure distribution at the upstream open end 40*a* and the downstream open end 40*b* of the tail pipe 40. The sound pressure of the air column resonance of the primary component has a maximum value at the center (½ $L_3$) in the axial direction of the tail pipe 40, while the sound pressure of the air column resonance of the secondary component has a maximum value at the position ¼ $L_3$ shifted from the center in the axial direction of the tail pipe 40.

Figure 6:
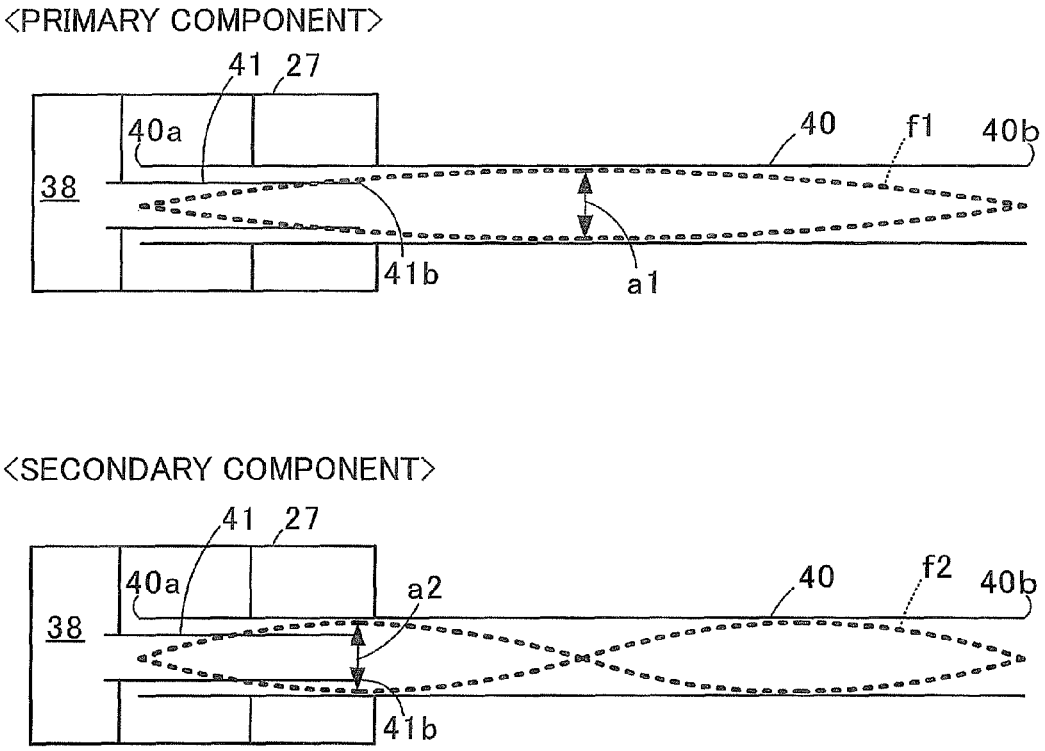
FIG. 6 shows a view of the first embodiment of the exhaust apparatus of the internal combustion engine according to the present invention, and is a view for explaining a primary component and the secondary component of standing waves in sound pressure distributions of air column resonances caused by an open end reflection generated in the tail pipe.

In the present embodiment, the downstream open end 41*b* of the inner pipe 41 is, as shown in FIG. 6, located at the upstream side of the center portion in the axial direction of the tail pipe 40, i.e., at the high sound pressure position of the air column resonance. More specifically, the downstream open end 41*b* of the inner pipe 41 is located at the abdominal (antinode) portion of the sound pressure of the secondary component f2, i.e., close to the abdominal portion of the primary component f1.

Next, the operation of the embodiment will be described hereinafter. The exhaust gas discharged from each cylinder of the engine 21 is introduced into the catalytic converter 24 through the exhaust manifold 22, and the reduction of NOx, and oxidization of CO, HC are performed by the catalytic converter 24 during the operation of the engine 21.

The exhaust gas discharged from the catalytic converter 24 is introduced into the muffler 27 through the front pipe 25 and the center pipe 26. The exhaust gas introduced into the muffler 27 is introduced into the expansion chambers 36, 37 through the through bores 39*b*, 39*c* of the inlet pipe 39, and then introduced into the passage 43 through the upstream open end 40*a* of the tail pipe 40. The exhaust gas introduced into the passage 43 is discharged to the downstream side of the tail pipe 40 from the passage 43, and then discharged to the atmosphere from the downstream open end 40*b* of the tail pipe 40.

The exhaust sounds of the exhaust gas introduced into the tail pipe 40 are incident waves caused by the pulsation of the exhaust gas variable in response to the rotation speed of the engine 21 during the operation of the engine 21, and the frequency of the incident wave is increased in response to the increase of the rotation speed of the engine 21.

When the incident wave caused by the exhaust pulsation at the time of the engine 21 being operated is introduced into the tail pipe 40, the incident wave causes an open end refection and becomes a reflection wave, as it is so called, at the downstream open end 40*b* of the tail pipe 40. The reflection wave is the same in phase as the incident wave and is opposite in advance direction to the incident wave. The reflection wave again causes an open end reflection at the upstream open end 40*a* to become a new reflection wave the same in phase as the previous reflection wave and is opposite in advance direction to the previous reflection wave. This new reflection wave thus generated comes to be another incident wave and then becomes another reflection wave again at the upstream open end 40*a*.

The reason why the open end reflection is caused at the upstream open end 40*a* is due to the fact that the pressure of the exhaust gas flowing in the tail pipe 40 is high while the pressure of the outer space outward of the downstream open end 40*b* of the tail pipe 40 is low. Therefore the incident wave vigorously discharged to the atmosphere causes the pressure of the exhaust gas in the downstream open end 40*b* to be decreased, thereby causing the exhaust gas having the decreased pressure at the downstream open end 40*b* to start advancing toward the upstream open end 40*a*.

Therefore, the reflection wave comes to be the same in phase as the incident wave and is opposite in advance direction to the incident wave. Further, the reason why the reflection wave is generated at the upstream open end 40*a* is the same as the reason why the reflection wave is generated at the downstream open end 40*b*.

The incident wave toward the downstream open end 40*b* is interfered with the reflection wave opposite in advance direction to the incident wave, thereby generating a standing wave having a sound pressure minimum at the upstream open end 40*a* and the downstream open end 40*b* of the tail pipe 40 as shown in FIG. 5.

When the pipe length $L_3$ of the tail pipe 40 is in a specific relationship with a wavelength λ of the standing wave, the standing wave becomes remarkably large in amplitude and generates an air column resonance. The air column resonance has a half wavelength equal to the pipe length $L_3$ of the tail pipe 40 as a basic component, and has wavelengths obtained by multiplying the half wavelength by natural numbers, and thus the sound pressure in the tail pipe 40 is increased.

Here, assuming that the speed of sound in air is c, the length of the tail pipe 40 is $L_3$, and the degree is m, the frequency fm of the air column resonance of the tail pipe 40 is given by the following equation (4).

$$fm=(c/2L_3)\cdot m \quad (4)$$

Figure 7:
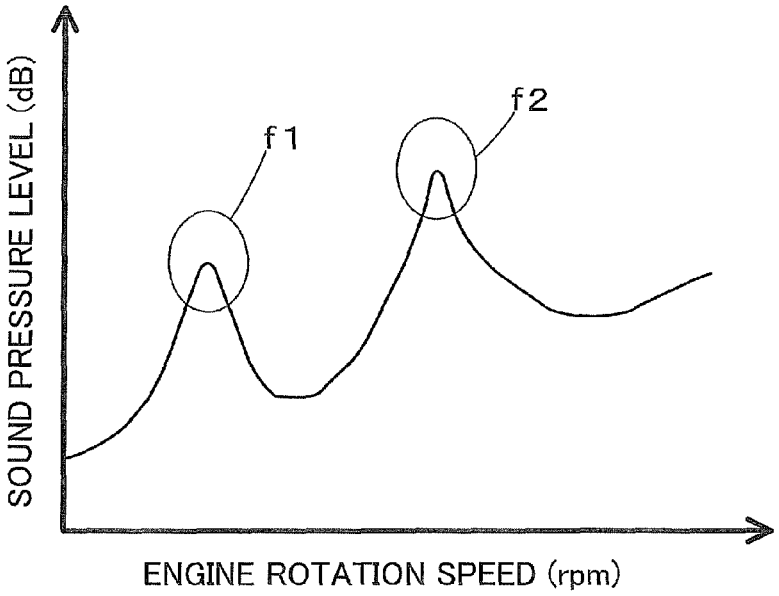
FIG. 7 shows a view of the first embodiment of the exhaust apparatus of the internal combustion engine according to the present invention, and is a graph showing the relationship between a sound pressure level in the tail pipe and an engine rotation speed.

As shown in FIG. 7, the frequency of the exhaust pulsation of engine 21 is increased in response to the increase of the rotation speed of the engine 21, the sound pressure levels (dB) of the exhaust gas are increased at the rotation speeds of the engine 21 corresponding to the frequencies of the air column resonance of the primary component f1, and the secondary component f2.

Therefore, in the case of using the tail pipe 40 having a long pipe length (e.g., a pipe length equal to or longer than 1.5 m), the air column resonance is generated in the normal rotation area (2000 rpm to 5000 rpm) where the rotation speed of the engine 21 is low. As a result, unpleasant noises called muffled sounds are generated in the normal rotation area, thereby causing deteriorated exhaust gas noises, and thus leading to imparting unpleasant feelings to the driver.

As will be understood from the foregoing description, the exhaust apparatus according to the present embodiment is constructed to reduce the sound pressure level of the air column resonance which has the primary component f1 and the secondary component f2 as the air column resonance frequency in the normal rotation area of the engine 21. Therefore, the exhaust apparatus can reduce the exhaust noises and thus prevent the driver from being given the unpleasant feelings.

Figure 8:
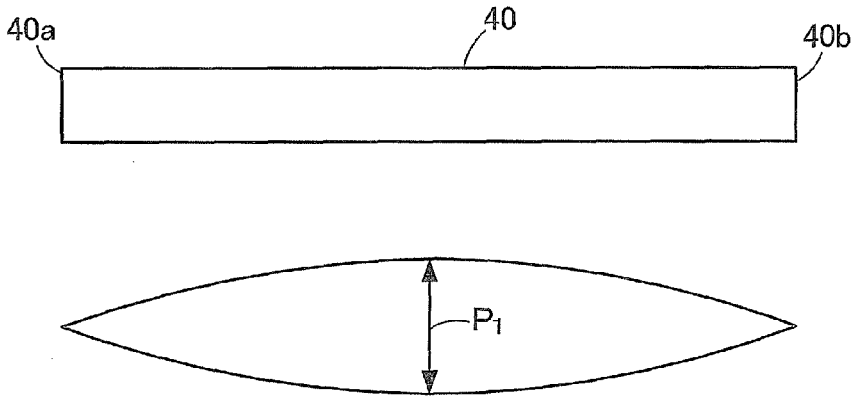
FIG. 8 shows a view of the first embodiment of the exhaust apparatus of the internal combustion engine according to the present invention, and is a view showing a sound pressure distribution of an air column resonance generated in the tail pipe with no inner pipe provided therein.

In the sound pressure distribution of the primary component f1 of the standing wave of the air column resonance when the air column resonance is generated in the tail pipe 40 without the inner pipe 41 as shown in FIG. 8, the upstream open end 40*a* and the downstream open end 40*b* of the tail pipe 40 become nodes of the sound pressure distribution of the standing wave of the air column resonance, and thus the sound pressure of the standing wave of the air column resonance has minimum values at the upstream open end 40*a* and the downstream open end 40*b*. The central portion of the tail pipe 40 becomes an abdominal (antinode) portion of the sound pressure distribution of the standing wave of the air column resonance, so that the sound pressure of the standing wave of the air column resonance reaches the peak P1 at the central portion of the tail pipe 40.

In the present embodiment, the inner pipe 41 having the upstream open end 41*a* and the downstream open end 41*b* is disposed in the tail pipe 40, and the upstream open end 41*a* of the inner pipe 41 is protruded outwardly from the inside of the tail pipe 40, and thus the inner pipe 41 has an inner space to be held in communication with the resonance chamber 38. Therefore, the upstream open end 41*a* is closed by the resonance chamber 38 defined by the outer shell 31 of the muffler 27, the end plate 32, and the partition plate 34, thereby making it is possible to generate the pressure energy of the exhaust gas in the tail pipe 40, i.e., the pressure distribution A1 of the pressure energy of the air in the inner pipe 41 and the resonance chamber 38 (see FIG. 9).

As a result, the pressure energy can be accumulated in the inner pipe 41 and the resonance chamber 38, so that the pressure energy is retained in the inner pipe 41 and the resonance chamber 38, and not released to the outside at the time of the air column resonance. Therefore, the pressure energy in the tail pipe 40 can be, as shown in FIG.9, distributed into the pressure energy A1 in line with the pressure distribution of the inner pipe 41 and the resonance chamber 38, and the pressure energy A2 in line with the pressure distribution of the tail pipe 40 except for the inner pipe 41 and the resonance chamber 38, thereby making it possible to discharge to the outside only the pressure energy of the tail pipe 40 except for the inner pipe 41 and the resonance chamber 38.

Figure 10:
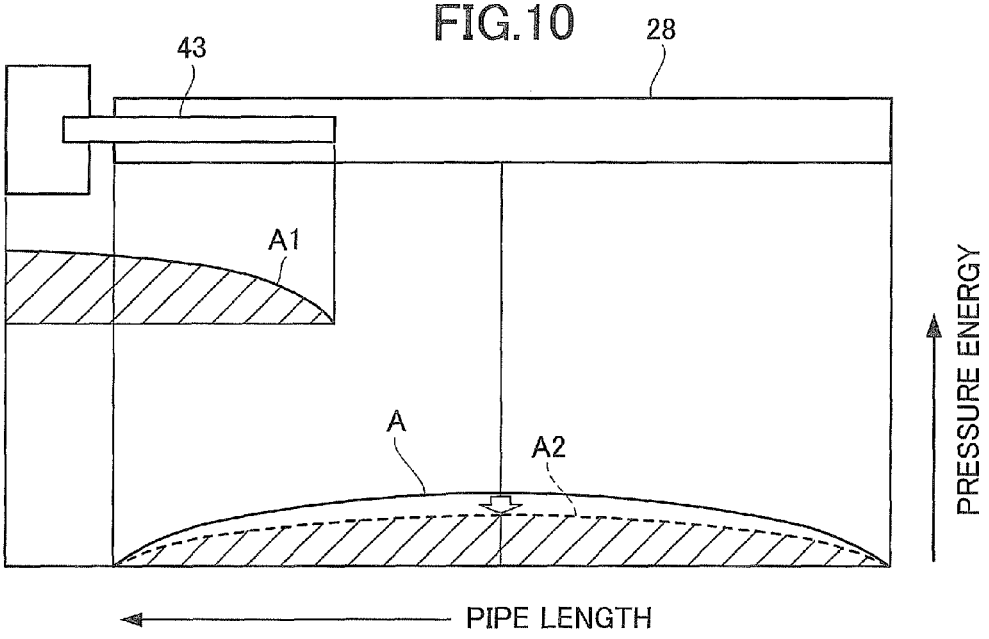
FIG. 10 shows a view of the first embodiment of the exhaust apparatus of the internal combustion engine according to the present invention, and is a view for explaining the scattered pressure energy of the air column resonance generated in the tail pipe and the sound pressure reduced.

That is, as shown in FIG. 10, the pressure energy A2 (shown by hatching) remaining after subtracting the pressure energy A1 (shown by hatching) in the inner pipe 41 and the resonance chamber 38 from the pressure energy A in the tail pipe 40 is discharged to the outside from the tail pipe 40.

Figure 9:
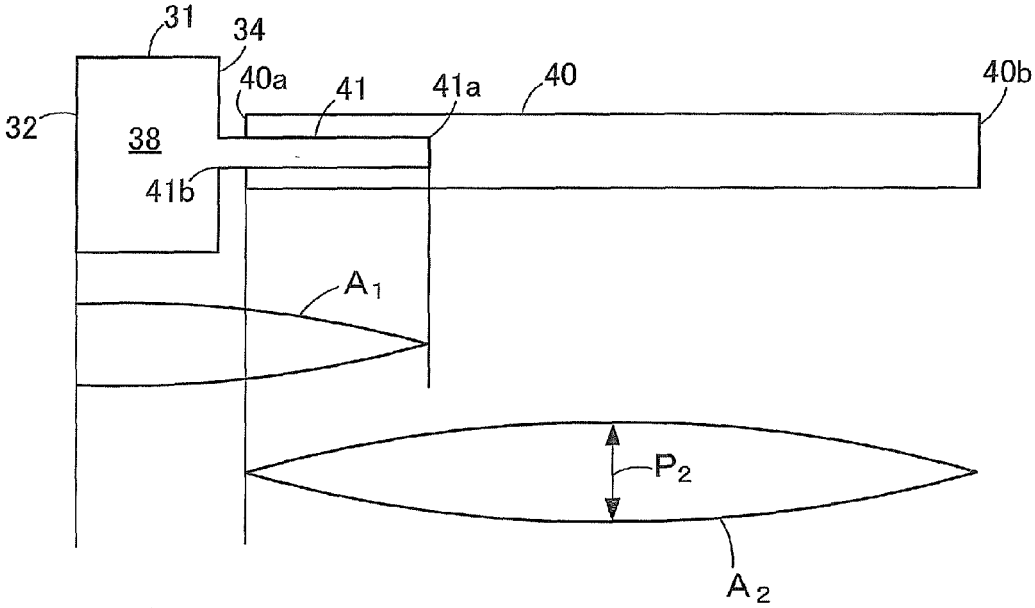
FIG. 9 shows a view of the first embodiment of the exhaust apparatus of the internal combustion engine according to the present invention, and shows a state in which the pressure energy of the air column resonance generated in the tail pipe is scattered.

As the sound pressure level of the air column resonance is determined by the pressure energy, by reducing the pressure energy, i.e., by reducing the pressure energy of the tail pipe 40 to the pressure energy A2 only, it is possible to reduce the sound pressure level by lowering the peak of the sound pressure from the peak P1 to the peak P2 (see FIG. 8, FIG. 9).

As the inner pipe 41 and the resonance chamber 38 have a big capacity to accumulate the pressure energy therein, it is possible to reduce significantly the pressure energy discharging from the tail pipe 40. Therefore, it is possible to reduce the sound pressure level by lowering the sound pressure peak at the time of the air column resonance, and reduce the exhaust noises.

On the other hand, as mentioned above, the sound waves (incident waves and reflection waves) caused by the exhaust pulsation repeat the open end reflections and thus the standing wave is generated, when the pipe length $L_3$ of the tail pipe 40 is in a specific relationship with the wavelength $\lambda$ of the standing wave, the amplitude of the standing wave is increased significantly, resulting in generating the air column resonance.

In the present embodiment, as the inner pipe 41 having the downstream open end 41*b* open at the upstream side of the tail pipe 40 is disposed in the tail pipe 40, and the upstream open end 41*a* is closed by the resonance chamber 38, the inner pipe 41 and the resonance chamber 38 can be in face-to-face relationship with each other in the direction of propagation of the sound waves and the downstream open end 41*b* of the inner pipe 41 can be placed at the generation portion of the air column resonance.

As a result, it is possible to make the inner pipe 41 and the resonance chamber 38 a Helmholtz resonance chamber serving as a sound source of the air column resonance, and to suppress the air column resonance by matching the resonance frequency of the resonance chamber 38 to the air column resonance frequency of the tail pipe 40.

Figure 11:
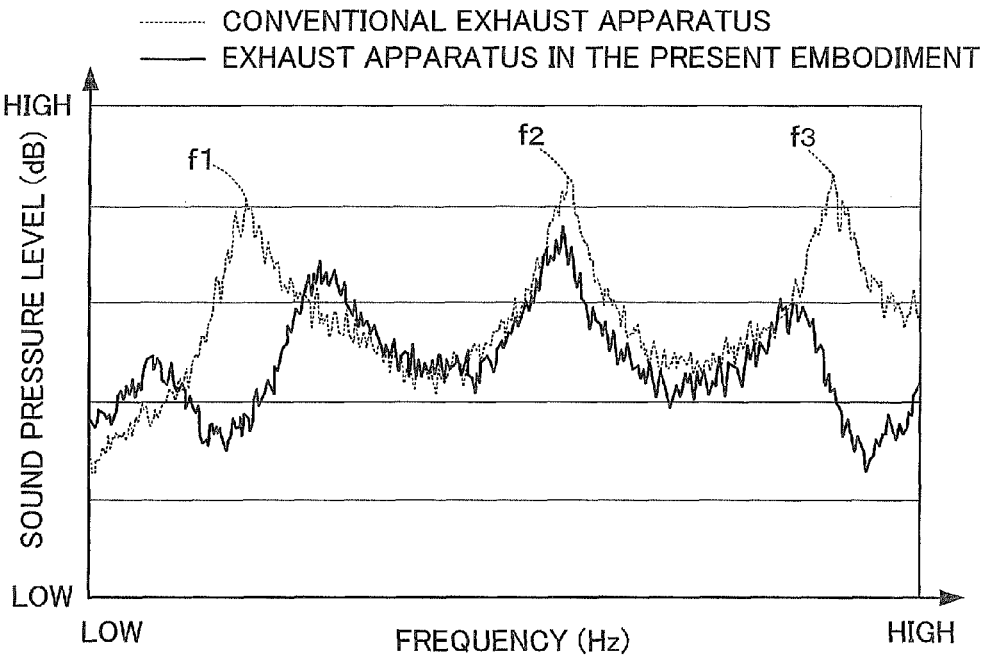
FIG. 11 shows a view of the first embodiment of the exhaust apparatus of the internal combustion engine according to the present invention, and shows relationships between the sound pressure level and the frequency measured in the speaker vibration test conducted by the tail pipe forming part of the present embodiment and a conventional tail pipe with no inner pipe.

FIG. 11 shows the relationship between the sound pressure level (dB) of the exhaust sound and the frequency of the exhaust pulsation according to the measurement results of the speaker vibration test carried out using the tail pipe 40 having the inner pipe 41 closed by the resonance chamber 38 at the upstream open end 41*a*. In FIG. 11, the solid line shows the measurement results using the tail pipe 40 of the present embodiment having the inner pipe 41, while the dashed line shows the measurement results using the conventional tail pipe not having the inner pipe therein.

In the present embodiment, it is possible to reduce the sound pressure itself, as shown in FIG. 11, thereby making it is possible to reduce the sound pressure in all of the operation areas not only at the time of the air column resonance but also at the time other than the air column resonance (the frequency corresponds to the rotation speed of the engine 21), and to suppress further the air column resonance (primary component f1, secondary component f2, and tertiary component f3) by the Helmholtz resonance depending on the length $L_2$ of the inner pipe 41 in addition to the reduction of the sound pressure at the time of the air column resonance. For this reason, it is possible to drastically reduce the exhaust noises.

In particular, as shown in FIG. 6, the downstream open end 41*b* of the inner pipe 41 is positioned at the side upstream of the center portion of the tail pipe 40 in the axial length of the tail pipe 40, thereby making it possible to position the downstream open end 41*b* of the inner pipe 41 in the high sound pressure area of the standing wave of the air column resonance, more specifically at the abdominal (antinode) portion a2 of the sound pressure distribution of the secondary component f2 which is on the upstream side than the abdominal portion a1 of the sound pressure distribution of the primary component, and to further suppress the air column resonance by the Helmholtz resonance effect.

In the present embodiment, as the downstream open end 41*b* of the inner pipe 41 can be placed at the generation portion of the air column resonance, it is possible to sufficiently suppress the air column resonance even if the exhaust gas flow introduced into the muffler 27 is drastically decreased at the time of the deceleration of the vehicle.

As a consequence, it is possible to eliminate a sub-muffler used in the conventional exhaust apparatus and make small in size the muffler 27, and thus reduce the weight and the production cost of the muffler 27.

Figure 12:
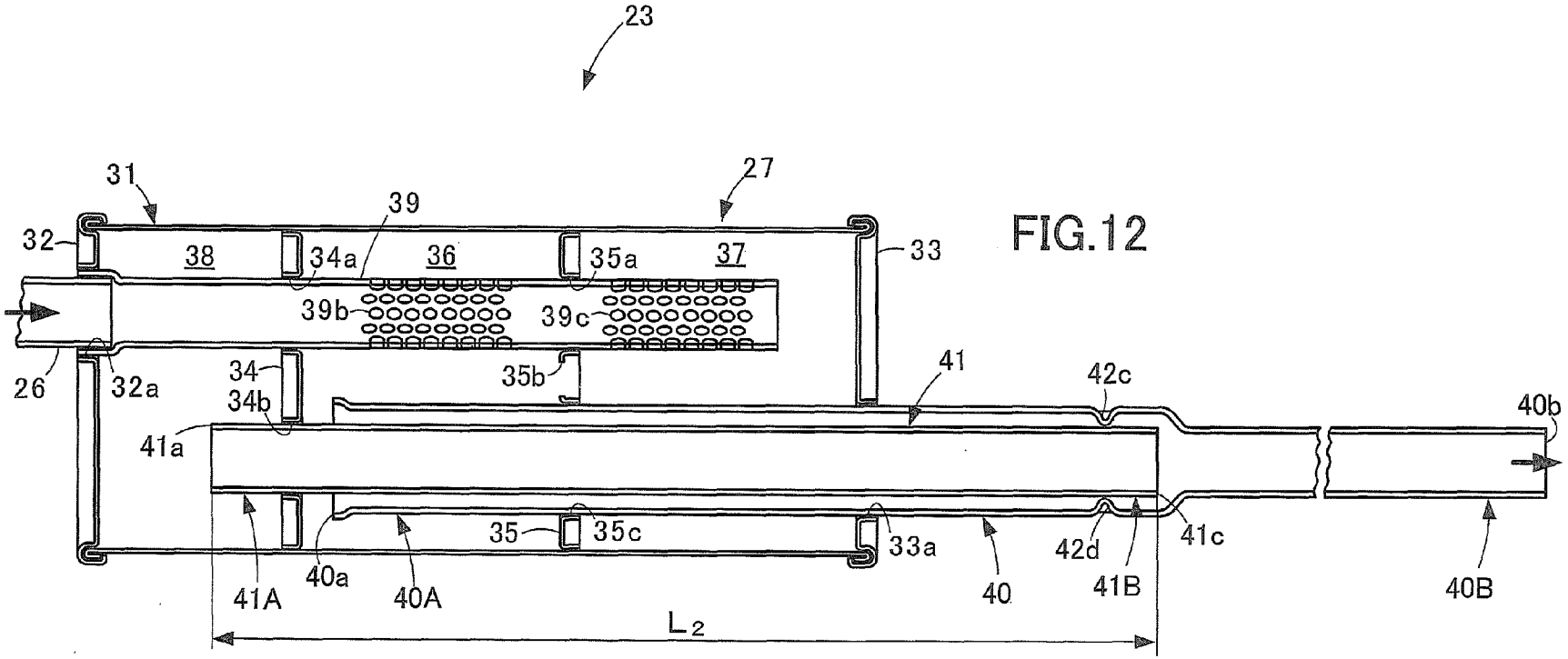
FIG. 12 shows a view of the first embodiment of the exhaust apparatus of the internal combustion engine according to the present invention, and is a cross-sectional view of the showing a muffler and a tail pipe having an inner pipe in another shape.
Figure 13:
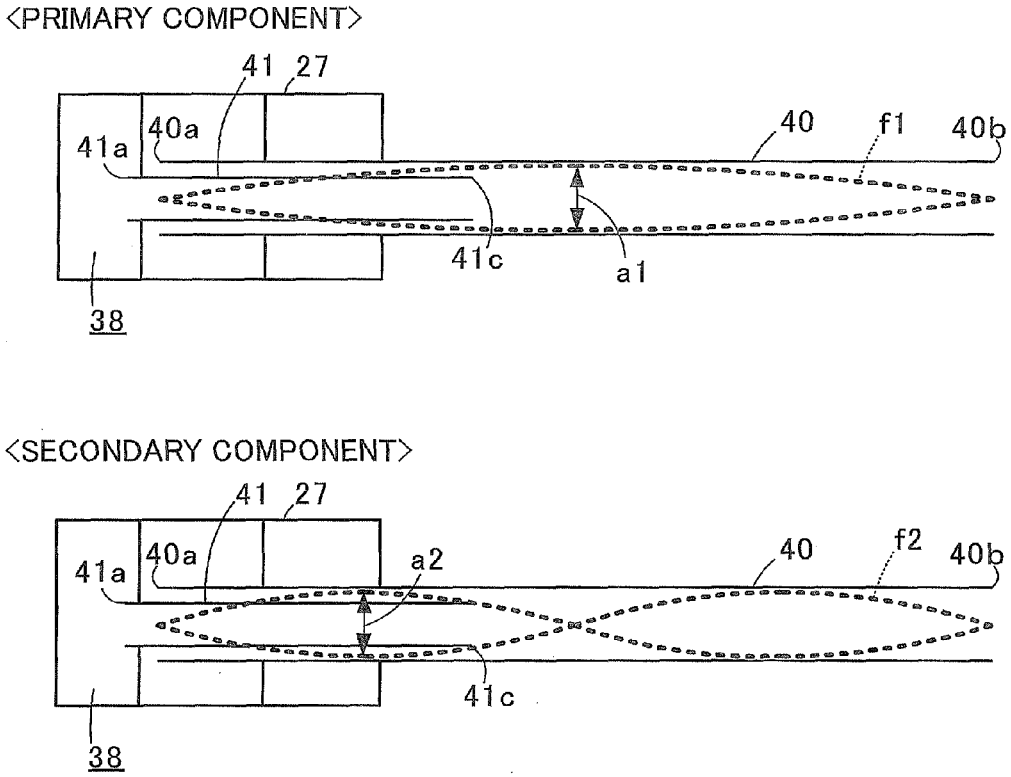
FIG. 13 shows a view of a first embodiment of the exhaust apparatus of the internal combustion engine according to the present invention, and are views for explaining the positional relationships between abdominal portions and inner pipes, the abdominal portions being of the primary component and the secondary component of the standing waves in the sound pressure distributions of the air column resonances generated in the tail pipes each having an inner pipe in another shape.

In addition, in the present embodiment, the inner pipe 41 is positioned inside of the muffler 27, as shown in FIG. 12 and FIG. 13, the downstream open end 41*c* of the inner pipe 41 can be extended to the side of the downstream open end 40*b* of the tail pipe 40 from inside the muffler 27, and can be positioned between the abdominal portion a1 of the sound pressure distribution of the primary component f1 and the abdominal portion a2 of the sound pressure distribution of the secondary component f2.

In this way, the primary component f1 and the secondary component f2 of the air column resonance can be further reduced by the Helmholtz resonance, thereby making it possible to further prevent the muffled sound from being generated in the area of the normal rotation of the engine 21.

In the case the inner pipe 41 is disposed in the tail pipe 40 so that the downstream open end 41*c* of the inner pipe 41 is positioned between the abdominal portion a1 of the sound pressure distribution of the primary component f1 and the abdominal portion a2 of the sound pressure distribution of the secondary component f2, the projecting portion 42*c*, 42*d* can be formed at the inner circumferential portion of the tail pipe 40 which is located outside of the muffler 27 so that the tail pipe 40 can support the inner pipe 41 by the projecting portions 42*c*, 42*d*. In addition, the length of the inner pipe 41 and the volume V of the resonance chamber 38 can be appropriately set so that the resonance frequency of the resonance chamber 38 is matched to the air column resonance frequency of the tail pipe 40.

In the present embodiment, as the outer peripheral portion of the upstream portion 41A of the inner pipe 41 is supported at the inner peripheral portion of the partition plate 34 of the resonance chamber 38, and the upper portion and the lower portion of the downstream portion 41B which are parts of the circumferential direction of the downstream portion 41B are supported by the projecting portions 42*a*, 42*b* at the inner peripheral of the tail pipe 40, the upstream portion 41A and the downstream portion 41B of the inner pipe 41 can be both supported at the partition plate 34 of the resonance chamber 38 and the tail pipe 40 respectively, thereby making it possible to firmly attach the inner pipe 41 to the tail pipe 40. In addition, in the present embodiment, as the single tail pipe 40 is attached to the muffler 27, it is possible to use the upstream portion of the tail pipe 40 as the outlet pipe, thereby making it possible to reduce the number of the parts of the exhaust apparatus 23 and further suppress the production cost of the exhaust apparatus 23.

(Second Embodiment)

Figure 14:
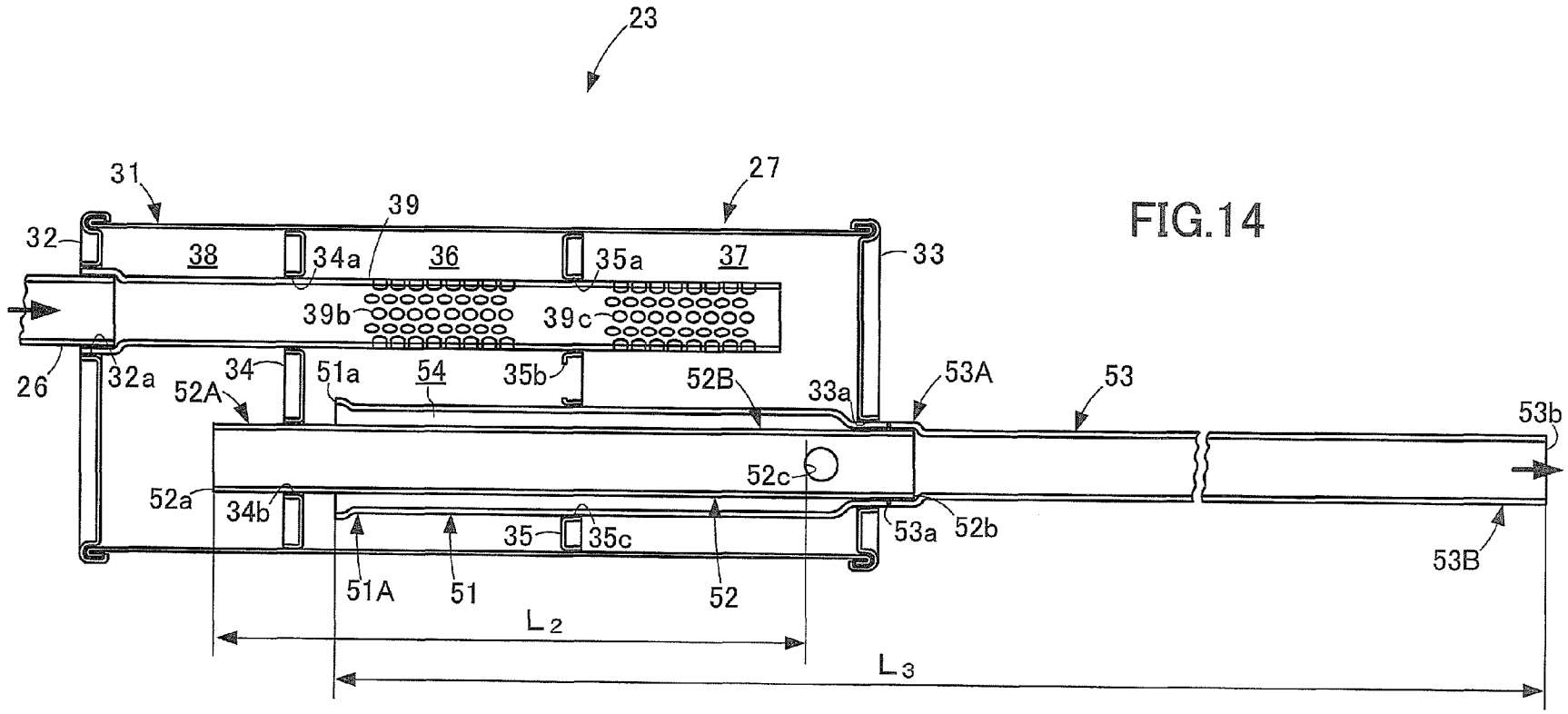
FIG. 14 shows a view of the second embodiment of the exhaust apparatus of the internal combustion engine according to the present invention, and shows a cross-sectional view of a muffler and a tail pipe.

FIG. 14 is a view showing a second embodiment of the exhaust apparatus for the internal combustion engine according to the present invention. The constitution parts and elements forming the second embodiment the same as those of the first embodiment bear the same reference numerals as those of the first embodiment, and will be omitted from being explained hereinafter to avoid tedious repetition therefor. In FIG. 14, the outer pipe 51 is disposed in the muffler 27, and the outer pipe 51 is received in the through bores 35*c*, 33*a* of the partition plate 35 and the end plate 33, and thus supported by the partition plate 35 and the end plate 33 in the expansion chambers 36, 37.

The outlet pipe 52 is disposed in the outer pipe 51, and the outlet pipe 52 is received in the through bores 34*a* and 33*a* of the partition plate 34 and the end plate 33, and thus the upstream portion 52A and the downstream portion 52B are both supported by the partition plate 34 and the end plate 33.

The upstream portion 53A of the tail pipe 53 is connected to the downstream portion 52B of the outlet pipe 52 as a hollow member by welding or the like, and the downstream open end 52*b* of the outlet pipe 52 is positioned at the downstream side of the upstream open end 53*a* of the tail pipe 53, and thus the downstream open end 52*b* of the outlet pipe 52 is held in communication with the upstream portion 53A of the tail pipe 53.

The downstream portion 52B of the outlet pipe 52 is formed with a bore 52*c*, and the passage 54 defined by the inner peripheral potion of the outer pipe 51 and the outer peripheral portion of the outlet pipe 52 is held in communication with the inside of outlet pipe 52 through the bore 52*c*.

The upstream open end 52*a* of the upstream portion 52A of the outlet pipe 52 is held in communication with the resonance chamber 38 by being protruded outwardly from the inside of the outer pipe 51, and the upstream open end of 52*a* of the outlet pipe 52 is closed by the resonance chamber 38 defined by the wall portion of the sound deadening device which is constituted by the outer shell 31, the end plate 32, and the partition plate 34.

Next, the operation of the embodiment will be described hereinafter. The exhaust gas introduced into the muffler 27 is introduced into the expansion chambers 36, 37 through the through bores 39*b*, 39*c* of the inlet pipe 39, then introduced into the passage 54 defined by the inner peripheral portion of the outer pipe 51 and the outer peripheral portion of the outlet pipe 52 from the upstream open end 51*a* of the outer pipe 51.

The exhaust gas is introduced into the outlet pipe 52 through the bore 52*c* of the outlet pipe 52, and discharged to the atmosphere from the downstream open end 53*b* of the downstream portion 53B of the tail pipe 53 through the tail pipe 53.

In the present embodiment, the outer pipe 51 and the tail pipe 53 constitute the exhaust pipe which exhausts the exhaust gas, and the upstream portion 51A of the outer pipe 51 constitutes the upstream portion of the exhaust pipe and the upstream open end 51*a* of the outer pipe 51 constitutes the upstream open end of the exhaust pipe. In addition, the downstream portion 53B of the tail pipe 53 constitutes the downstream portion of the exhaust pipe, and the downstream open end 53*b* of the tail pipe 53 constitutes the downstream open end of the exhaust pipe.

The air column resonance is generated in the outer pipe 51 and tail pipe 53, which has a frequency corresponding to a half wavelength equal to the total length $L_3$ of the outer pipe 51 and tail pipe 53 as a basic component, and has wavelengths obtained by multiplying the half wavelength by natural numbers.

In the present embodiment, the outlet pipe 52 having the upstream open end 52*a* and the downstream open end 52*b* is disposed in the outer pipe 51, and the upstream open end 52*a* of the outlet pipe 52 is protruded outwardly from the inside of the outer pipe 51, and thus the outlet pipe 52 has an inner space held in communication with the resonance chamber 38. Therefore, the upstream open end 52*a* is closed by the resonance chamber 38 defined by the outer shell 31 of the muffler 27, the end plate 32, and the partition plate 34, thereby making it is possible to generate the pressure distribution of the pressure energy of the outer pipe 51 and the tail pipe 53 in the outlet pipe 52 and the resonance chamber 38, and to reduce the sound pressure itself in the same manner as that of the first embodiment.

The outlet pipe 52 having the downstream open end 52*b* open at the upstream side of the tail pipe 53 is disposed in the outer pipe 51, and the upstream open end 52*a* is closed by the resonance chamber 38, and thus the outlet pipe 52 and the resonance chamber 38 can be in face-to-face relationship with each other in the direction of propagation of the sound waves and the downstream open end 52*b* of the outlet pipe 52 can be placed at the generation portion of the air column resonance, thereby making it possible to have the outlet pipe 52 and the resonance chamber 38 as the Helmholtz resonance chamber serving as the sound source of the air column resonance. Therefore, the air column resonance can be suppressed by matching the resonance frequency of the resonance chamber 38 to the frequency of the air column resonance of the outer pipe 51 and the tail pipe 53.

In the present embodiment, as the outlet pipe 52 has a bore 52*c* at the downstream portion 52B, a portion of the outlet pipe 52 from the bore 52*c* to the upstream open end 52*a* and the resonance chamber 38 constitute the Helmholtz resonance chamber. For this reason, it is possible to tune the resonance frequency of the resonance chamber 38 to the low frequency side by making the bore 52*c* close to the downstream open end 52*b* of the outlet pipe 52.

In the present embodiment as described above, as the sound pressure itself can be reduced, in the same manner as that of the first embodiment, it is possible to reduce the sound pressure in all of the operation areas not only at the time of the air column resonance but also at the time other than the air column resonance, and to further suppress the air column resonance by the Helmholtz resonance depending on the length $L_2$ from the upstream open end 52*a* to the bore 52*c* of the outlet pipe 52 and the volume of the resonance chamber 38 in addition to reducing the sound pressure at the time of the air column resonance. Therefore, the exhaust noises can remarkably be reduced.

As the downstream open end 52*b* of the outlet pipe 52 can be placed at the generation portion of the air column resonance, it is possible to sufficiently suppress the air column resonance even if the exhaust gas flow introduced into the muffler 27 is drastically decreased at the time of the deceleration of the vehicle.

As a consequence, it is possible to eliminate a sub-muffler used in the conventional exhaust apparatus and make small in size the muffler 27, and thus reduce the weight and the production cost of the muffler 27.

In addition, in the present embodiment, the air column resonance can be further suppressed by using the existing outlet pipe 52 as the hollow member for the muffler 27, thereby making it possible to suppress the increase of the production cost of the muffler 27.

(Third Embodiment)

Figure 15:
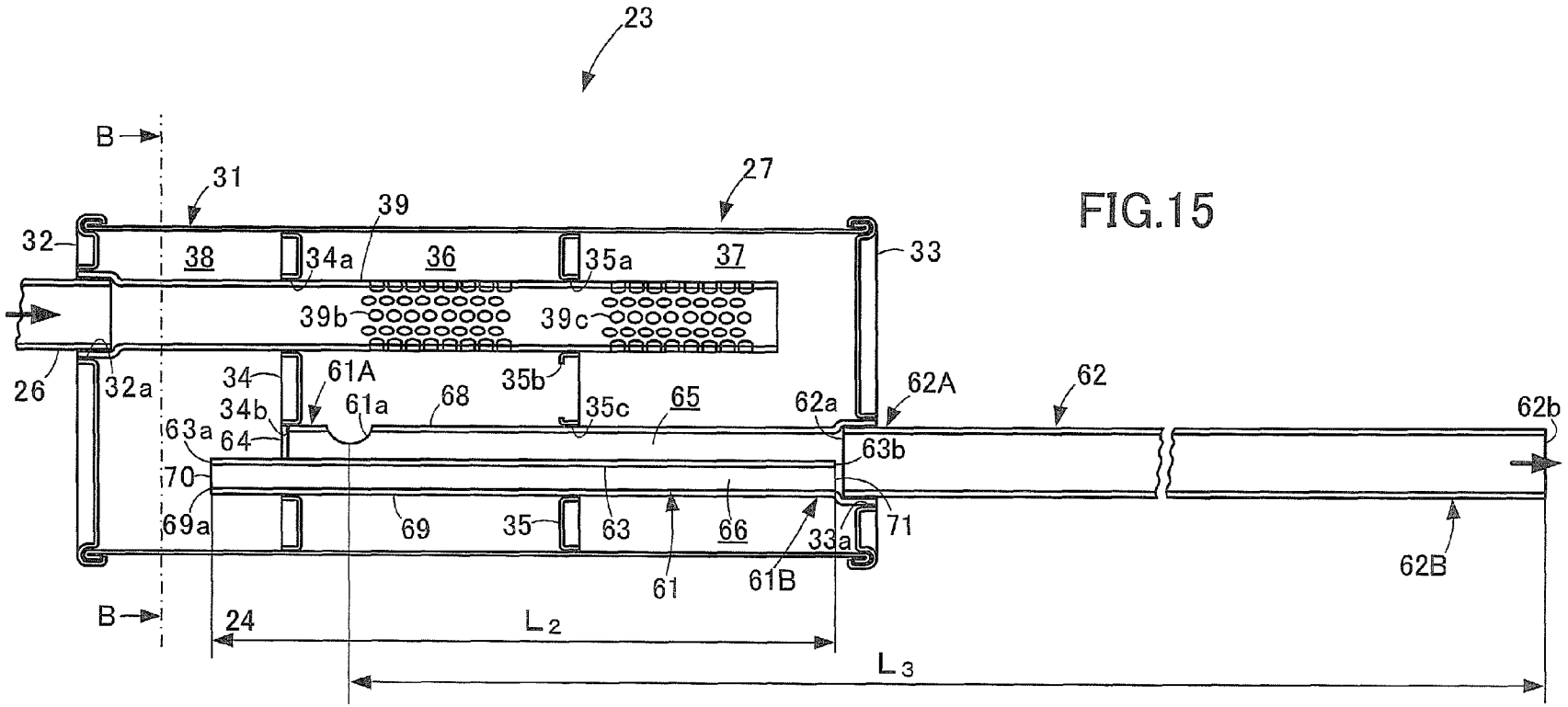
FIG. 15 shows a view of the third embodiment of the exhaust apparatus of the internal combustion engine according to the present invention, and shows a cross-sectional view of a muffler and a tail pipe.
Figure 16:
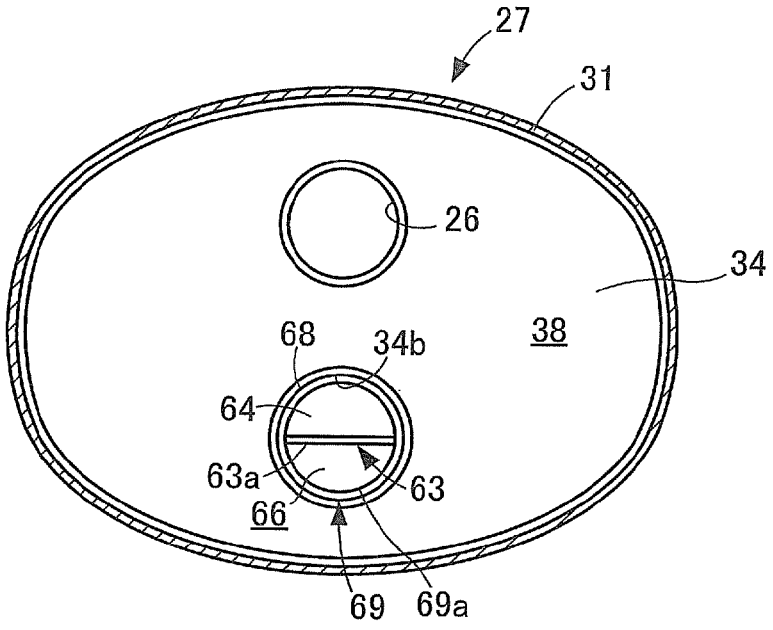
FIG. 16 shows a cross-sectional view taken along and seen from the line B-B in FIG. 15.

FIG. 15 and FIG. 16 are views showing a third embodiment of the exhaust apparatus for the internal combustion engine according to the present invention, and the constitution parts and elements forming the third embodiment the same as those of the first embodiment bear the same reference numerals as those of the first embodiment, and will be omitted from being explained hereinafter to avoid tedious repetition therefor. In FIG. 16, the outlet pipe 61 is disposed in the muffler 27, and the outlet pipe 61 is received in the through bores 34*b*, 35*c*, and 33*a* of the partition plates 34, 35, and the end plate 33, and thus supported by the partition plates 34, 35, and the end plate 33 in the expansion chambers 36 and 37.

The upstream portion 62A of the tail pipe 62 is connected to the downstream portion 61B of the outlet pipe 61 by welding or the like. The outlet pipe 61 is formed with the bore 61*a* as the upstream open end at the upstream portion 61A, and the exhaust gas introduced into the muffler 27 is introduced into the outlet pipe 61 through the bore 61*a*.

As shown in FIG. 15 and FIG. 16, the flat plate-shaped partition plate 63 is disposed in the outlet pipe 61, and the inner space of the outlet pipe 61 is partitioned into two exhaust passages, that is, one is the exhaust passage 65 which introduces the exhaust gas to inside the tail pipe 62 from the outlet pipe 61 through the upstream open end 62*a* of the tail pipe 62, and the other is the resonance passage 66 which is held in communication with the resonance chamber 38.

In other words, the exhaust passage 65 is formed with the semicircular passage defined by the upper portion surface of the partition plate 63 and the inner circumferential surface of the upper half circular portion 68 of the outlet pipe 61, and the resonance passage 66 is formed with the semicircular passage defined by the underside surface of the partition plate 63 and the inner circumferential surface of the down half circular portion 69 of the outlet pipe 61.

The closure plate 64 is disposed at the upstream end of the outlet pipe 61, and the upstream end of the outlet pipe 61 is closed by the closure plate 64. Therefore, the exhaust passage 65 of the outlet pipe 61 is not held in communication with the resonance chamber 38.

On the other hand, the upstream end 69*a* of the down half circular portion 69 of the outlet pipe 61 is extended into the resonance chamber 38 with the upstream end 63*a* of the partition plate 63 to be extended into the resonance chamber 38. As a result, the resonance passage 66 formed with the partition plate 63 and the down half circular portion 69 is closed by the resonance chamber 38 defined by the outer shell 31, the end plate 32, and the partition plate 34.

Therefore, in the present embodiment, the hollow member is formed with the partition plate 63 and the down half circular portion 69, and the upstream open end 70 is formed with the upstream end 63*a* of the partition plate 63 and the upstream end 69*a* of the down half circular portion 69, and then the downstream open end 71 as the downstream end is formed with the downstream end 63*b* of the partition plate 63 and the down half circular portion 69 just beneath the downstream end 63*b* of the partition plate 63.

Next, the operation of the embodiment will be described hereinafter. The exhaust gas introduced into the muffler 27 is introduced into the expansion chambers 36, 37 through the through bores 39*b*, 39*c* of the inlet pipe 39, and then introduced into the exhaust passage 65 from the bore 61*a* of the outlet pipe 61.

The exhaust gas is introduced into the tail pipe 62 from the exhaust passage 65 through the upstream open end 62*a* of the tail pipe 62, and discharged to the atmosphere from the downstream open end 62*b* of the tail pipe 62.

In the present embodiment, the outlet pipe 61 and the tail pipe 62 constitute the exhaust pipe which exhausts the exhaust gas, and the upstream portion 61A of the outlet pipe 61 constitutes the upstream portion of the exhaust pipe and the bore 61*a* of the outlet pipe 61 constitutes the upstream open end of the exhaust pipe. In addition, the downstream portion 62B of the tail pipe 62 constitutes the downstream portion of the exhaust pipe, and the downstream open end 62*b* of the tail pipe 62 constitutes the downstream open end of the exhaust pipe. Then, the air column resonance is generated in the outlet pipe 61 and tail pipe 62, which has a frequency corresponding to a half wavelength equal to the length $L_3$ from the bore 61*a* to the downstream open end 62*b* of the tail pipe 62 as a basic component, and has wavelengths obtained by multiplying the half wavelength by natural numbers.

In the present embodiment, the partition plate 63 is disposed in the outlet pipe 61 to constitute the upstream open end 70 and the downstream open end 71 with the down half circular portion 69 of the outlet pipe 61, and the upstream end 63*a* of the partition plate 63 and the upstream end 69*a* of the down half circular portion 69 are held in communication with the resonance chamber 38, and thus the upstream end 63*a* of the partition plate 63 and the upstream end 69*a* of the down half circular portion 69 are closed by the resonance chamber 38 defined by the outer shell 31, the end plate 32, and the partition plate 34, thereby making it possible to generate the pressure distribution of the pressure energy of the air of the outlet pipe 61 and the tail pipe 62 in the resonance passage 66 and the resonance chamber 38, and to reduce the sound pressure itself in the same manner as that of the first embodiment.

The partition plate 63 is disposed in the outlet pipe 61 so that the downstream open end 71 is open at the upstream side of the tail pipe 62 and the upstream open end 70 is closed by the resonance chamber 38, thereby making it possible that the resonance passage 66 and the resonance chamber 38 are faced in the direction of propagation of the sound waves and the downstream open end 71 is placed at the generation portion of the air column resonance. For this reason, the resonance passage 66 and the resonance chamber 38 can be the Helmholtz resonance chamber serving as the sound source of the air column resonance. Therefore, the air column resonance can be suppressed by matching the resonance frequency of the resonance chamber 38 to the frequency of the air column resonance of the exhaust passage 65 and the tail pipe 62, i.e., the exhaust pipe.

In the present embodiment as described above, as the sound pressure itself can be reduced, in the same manner as that of the first embodiment, it is possible to reduce the sound pressure in all of the operation areas not only at the time of the air column resonance but also at the time other than the air column resonance, and to further suppress the air column resonance by the Helmholtz resonance depending on the length $L_2$ of the down half circular portion 69 or the partition plate 63 and the volume of the resonance chamber 38 in addition to reducing the sound pressure at the time of the air column resonance. Therefore, the exhaust noises can remarkably be reduced.

As the downstream open end 71 constituted by the downstream end 63*b* of the partition plate 63 and the down half circular portion 69 of the outlet pipe 61 can be placed at the generation portion of the air column resonance, it is possible to sufficiently suppress the air column resonance even if the exhaust gas flow introduced into the muffler 27 is drastically decreased at the time of the deceleration of the vehicle.

As a consequence, it is possible to eliminate a sub-muffler used in the conventional exhaust apparatus and make small in size the muffler 27, and thus reduce the weight and the production cost of the muffler 27.

In addition, in the present embodiment, the air column resonance can be further suppressed by attaching the partition plate 63 to the existing outlet pipe 61 for the muffler 27 and using the outlet pipe 61 as the hollow member, thereby making it possible to suppress the increase of the production cost of the muffler 27.

(Fourth Embodiment)

Figure 17:
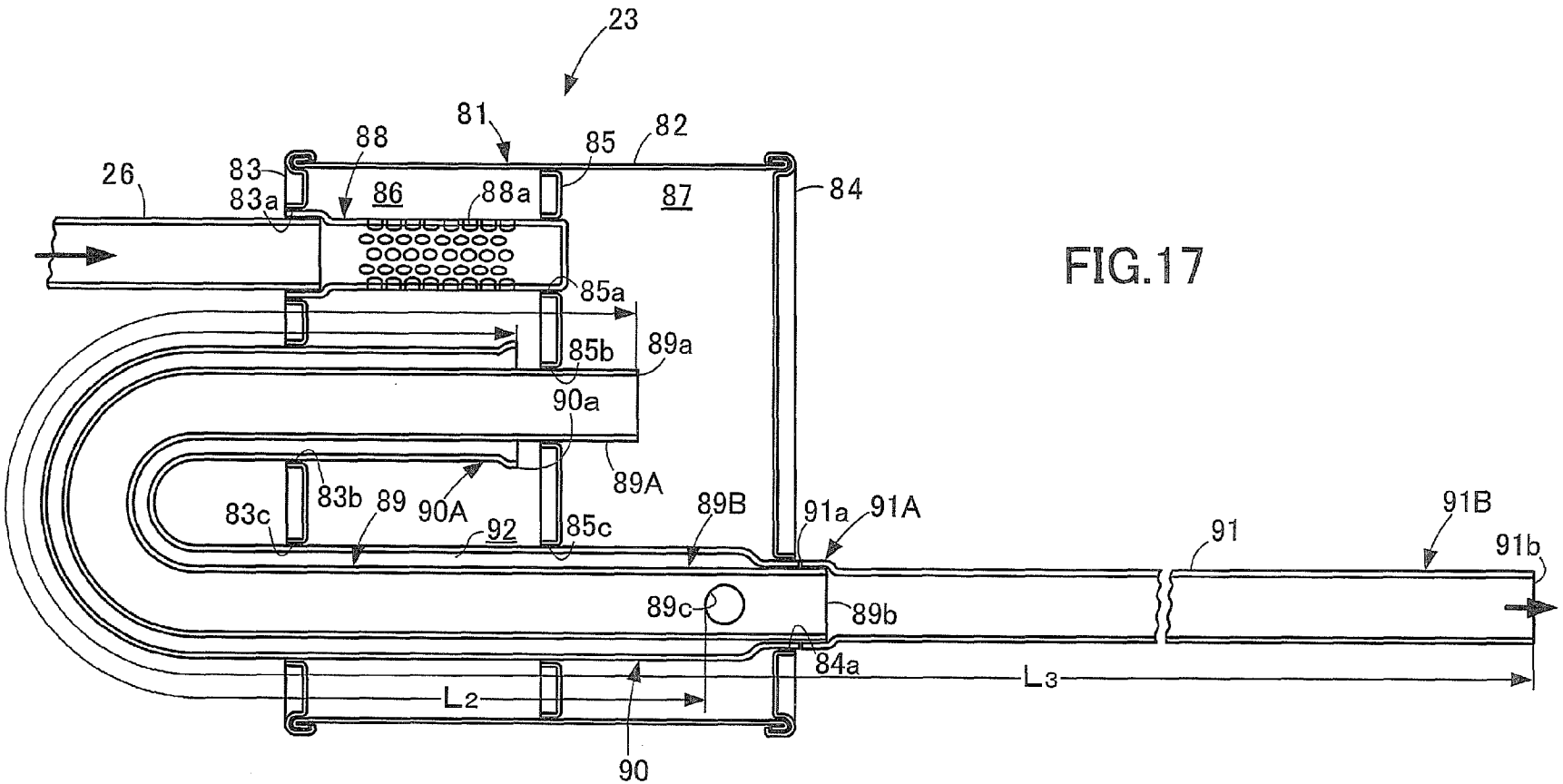
FIG. 17 shows a view of the fourth embodiment of the exhaust apparatus of the internal combustion engine according to the present invention, and shows a cross-sectional view of a muffler and a tail pipe.
Figure 18:
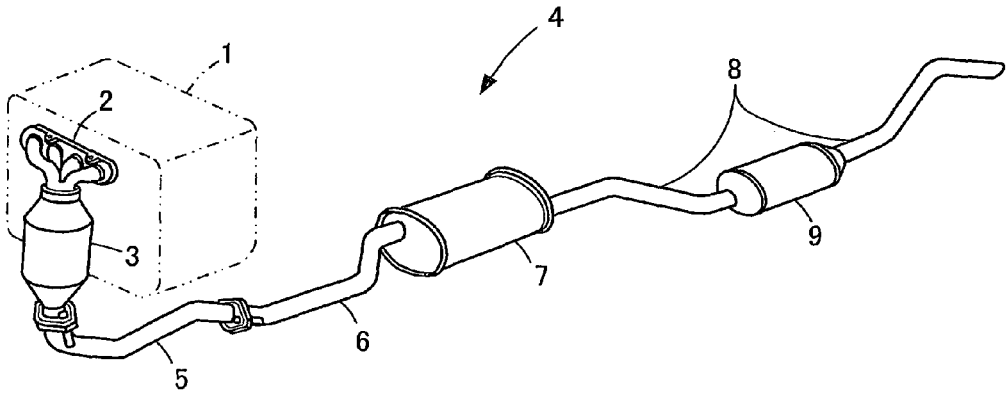
PRIOR ART FIG.18
FIG. 18 is a perspective construction view of the conventional exhaust apparatus of the internal combustion engine.
Figure 19:
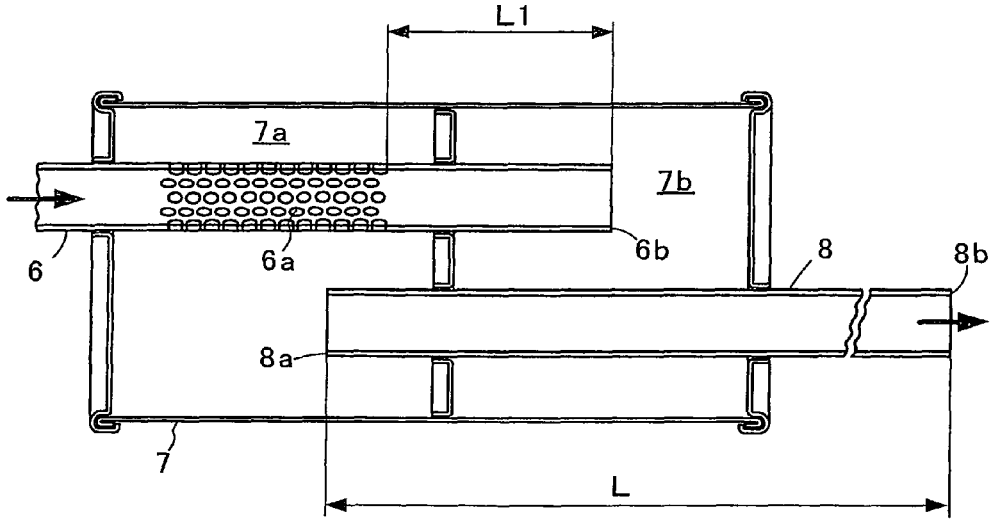
PRIOR ART FIG.19
FIG. 19 is a cross-sectional view of a conventional muffler.
Figure 20:
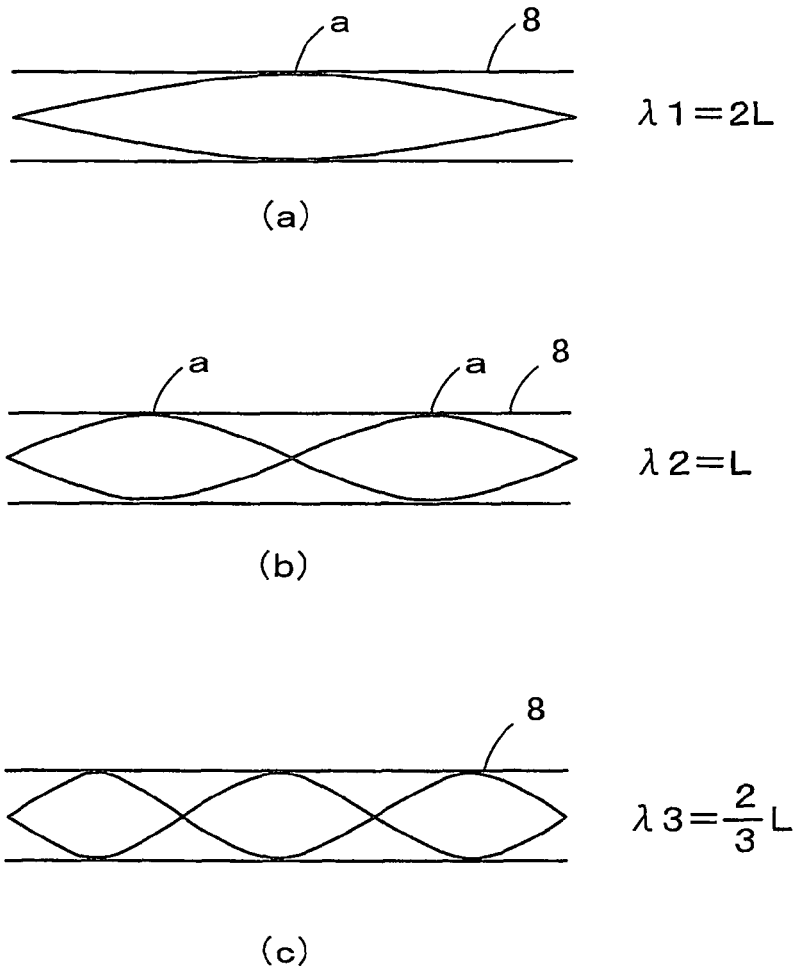
PRIOR ART FIG.20
FIG. 20 is explanatory views for explaining standing waves in sound pressure distributions of air column resonances each caused by an open end reflection generated in the tail pipe.
Figure 21:
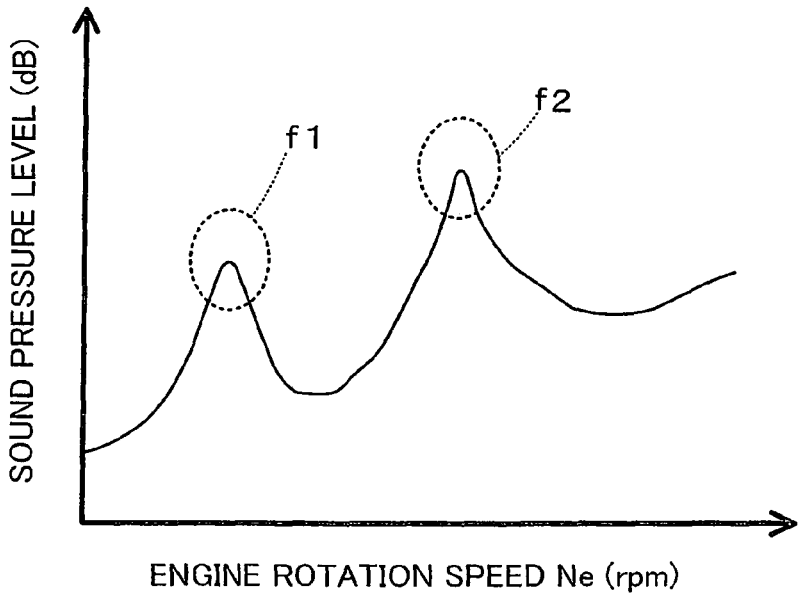
PRIOR ART FIG.21
FIG. 21 is a view showing the relationship between the sound pressure level of the conventional tail pipe and the rotation speed of the engine.

FIG. 17 is a view showing a fourth embodiment of the exhaust apparatus for the internal combustion engine according to the present invention, and the constitution parts and elements forming the fourth embodiment the same as those of the first embodiment bear the same reference numerals as those of the first embodiment, and will be omitted from being explained hereinafter to avoid tedious repetition therefor. In FIG. 17, the muffler 81 as the sound deadening device has an outer shell 82 formed in a cylindrical hollow and end plates 83, 84 to close the both ends of the outer shell 82.

The partition plate 85 is disposed in the outer shell 82, and the inner space of the outer shell 82 is partitioned into two chambers, that is, one chamber serving as an expansion chamber 86 to mute the exhaust sounds by expanding the exhaust gas, and the other chamber serving as a resonance chamber 87 to mute the exhaust sounds of a specific frequency by the Helmholtz resonance.

The end plate 83 and the partition plate 85 are formed with the through bores 83*a*, 85*a* respectively, and the inlet pipe 88 connected to the downstream portion of the center pipe 26 is received in the through bores 83*a*, 85*a*.

The inlet pipe 88 is supported by the end plate 83 and the partition plate 85 to be accommodated in the expansion chamber 86, and the inlet pipe 88 is closed at the downstream end but not extended into the resonance chamber 87.

The inlet pipe 88 is formed with plural small bores 88*a* in the axial direction (the discharging direction of the exhaust flow) and in circumferential direction of the inlet pipe 88, and the inside of the inlet pipe 88 is held in communication with the expansion chamber 86 through the small bores 88*a*. Therefore, the exhaust gas introduced from the center pipe 26 into the muffler 81 through the inlet pipe 88 is introduced into the expansion chamber 86 through the small bores 88*a*.

The end plates 83, 84 and the partition plate 85 are formed with the through bores 83*b*, 83*c*, 84*a*, 85*b*, and 85*c*, respectively, and the outlet pipe 89 serving as a hollow member having a bent shape is received in the through bores 85*b*, 83*b*, 83*c*, 85*c*, and 84*a*, and thus the outlet pipe 89 is supported by the end plate 83 and the partition plate 85.

In addition, the outer pipe 90 having a bent shape is received in the through bores 83*b*, 83*c*, 85*c*, and 84*a*. The outer pipe 90 accommodates the outlet pipe 89 therein, and is supported by the end plates 83, 84 and the partition plate 85.

The upstream portion 91A of the tail pipe 91 is connected to the downstream portion 89B of the outlet pipe 89 by welding or the like, and the downstream open end 89*b* of the outlet pipe 89 is positioned at the downstream side of the upstream open end 91*a* of the tail pipe 91, and thus the downstream open end 89*b* of the outlet pipe 89 is extended into the upstream portion 91A of the tail pipe 91.

The downstream portion 89B of the outlet pipe 89 is formed with a bore 89*c*, and the passage 92 defined by the inner peripheral potion of the outer pipe 90 and the outer peripheral portion of the outlet pipe 89 is held in communication with the inside of outlet pipe 89 through the bore 89*c*.

The upstream open end 89*a* as the upstream end of the outlet pipe 89 is held in communication with the resonance chamber 87 by being protruded outwardly from the inside of the outer pipe 90, and the upstream open end of 89*a* of the outlet pipe 89 is closed by the resonance chamber 87 defined by the wall portion of the sound deadening device which is constituted by the outer shell 82, the end plate 84, and the partition plate 85, FIG. 17 also illustrates an upstream portion 89A of the outlet pipe 89.

Next, the operation of the embodiment will be described hereinafter. The exhaust gas introduced into the muffler 81 is introduced into the expansion chamber 86 through the through bore 88*a* of the inlet pipe 88, and then introduced into the passage 92 defined by the inner peripheral portion of the outer pipe 90 and the outer peripheral portion of the outlet pipe 89 from the upstream open end 90*a* of the outer pipe 90.

The exhaust gas is introduced into the outlet pipe 89 through the bore 89*c* of the outlet pipe 89, and discharged to the atmosphere from the downstream open end 91*b* of the tail pipe 91 through the tail pipe 91.

In the present embodiment, the outer pipe 90 and the tail pipe 91 constitute the exhaust pipe which exhausts the exhaust gas. The upstream portion 90A of the outer pipe 90 constitutes the upstream portion of the exhaust pipe and the upstream open end 90*a* of the outer pipe 90 constitutes the upstream open end of the exhaust pipe.

In addition, the downstream portion 91B of the tail pipe 91 constitutes the downstream portion of the exhaust pipe, and the downstream open end 91*b* of the tail pipe 91 constitutes the downstream open end of the exhaust pipe. The air column resonance is generated in the outer pipe 90 and tail pipe 91, which has a frequency corresponding to a half wavelength equal to the total length $L_3$ of the outer pipe 90 and tail pipe 91 as a basic component, and has wavelengths obtained by multiplying the half wavelength by natural numbers.

In the present embodiment, the outlet pipe 89 having the upstream open end 89*a* and the downstream open end 89*b* is disposed in the outer pipe 90, and the upstream open end 89*a* of the outlet pipe 89 is protruded outwardly from the inside of the outer pipe 90, and thus the outlet pipe 89 has an inner space held in communication with the resonance chamber 87. Therefore, the upstream open end 89*a* is closed by the resonance chamber 87 defined by the outer shell 82, the end plate 83, and the partition plate 85, thereby making it is possible to generate the pressure distribution of the pressure energy of the outer pipe 90 and the tail pipe 91 in the outlet pipe 89 and the resonance chamber 87, and to reduce the sound pressure itself in the same manner as that of the first embodiment.

The outlet pipe 89 having the downstream open end 89*b* open at the upstream side of the tail pipe 91 is disposed in the outer pipe 90, and the upstream open end 89*a* is closed by the resonance chamber 87, and thus the outlet pipe 89 and the resonance chamber 87 can be in face-to-face relationship with each other in the direction of propagation of the sound waves and the downstream open end 89*b* of the outlet pipe 89 can be placed at the generation portion of the air column resonance, thereby making it possible to use the outlet pipe 89 and the resonance chamber 87 as the Helmholtz resonance chamber serving as the sound source of the air column resonance. Therefore, the air column resonance can be suppressed by matching the resonance frequency of the resonance chamber 87 to the frequency of the air column resonance of the outer pipe 90 and the tail pipe 91. In the present embodiment, as the outlet pipe 89 has a bore 89*c* at the downstream portion 89B, a portion of the outlet pipe 89 from the bore 89*c* to the upstream open end 89*a* and the resonance chamber 87 constitute the Helmholtz resonance chamber. For this reason, it is possible to tune the resonance frequency of the resonance chamber 87 to the low frequency side by making the bore 89*c* close to the downstream open end 89*b* of the outlet pipe 89.

In the present embodiment as described above, as the sound pressure itself can be reduced, in the same manner as that of the first embodiment, it is possible to reduce the sound pressure in all of the operation area not only at the time of the air column resonance but also at the time other than the air column resonance, and further suppress the air column resonance by the Helmholtz resonance depending on the length $L_2$ from the upstream open end 89*a* to the bore 89*c* of the outlet pipe 89 and the volume of the resonance chamber 87 in addition to reducing the sound pressure at the time of the air column resonance. Therefore, the exhaust noises can remarkably be reduced.

As the downstream open end 89*b* of the outlet pipe 89 can be placed in the generation portion of the air column resonance, it is possible to suppress sufficiently the air column resonance even if the exhaust gas flow introduced to the muffler 81 drastically decreases at the time of the deceleration of the vehicle.

As a consequence, it is possible to eliminate a sub-muffler used in the conventional exhaust apparatus and make small in size the muffler 81, and thus reduce the weight and the production cost of the muffler 81.

In the present embodiment, as the outlet pipe 89 and the outer pipe 90 are bent, the outlet pipe 89 can be lengthened in the muffler 81, and the muffler 81 can be shortened in the axial direction, thereby making it possible to tune the resonance frequency of the resonance chamber 87 to the low frequency side.

The previously mentioned embodiments have been raised as examples to explain the present invention, however, the present invention is not limited to these embodiments. The scope of the present invention should be construed based on the claims but not on these embodiments. It is needless to say that the equivalents and modifications of the elements or parts defined in claims should be incorporated within the scope of the present invention.

As previously mentioned, the exhaust apparatus for the internal combustion engine according to the present invention can reduce the noises of the exhaust gas without the sub-muffler used in the conventional vehicle. Moreover, the present invention not only can reduce the weight of the exhaust apparatus but also can decrease the production cost of the exhaust apparatus. The present invention is useful as an exhaust apparatus for an internal combustion engine which are designed to reduce the noises of the exhaust gas caused by the air column resonance of an exhaust pipe provided at the downstream end in the exhaust direction of the exhaust gas.

REFERENCE SIGNS LIST

21: engine (internal combustion engine)
23: exhaust apparatus
27, 81: muffler (sound muting device)
31, 82: outer shell (wall portion of muffler)
32, 84: end plate (wall portion of muffler)
34, 85: partition plate (wall portion of muffler)
38, 87: resonance chamber
40: tail pipe (exhaust pipe)
40A: upstream portion
40B: downstream portion
40*a:* upstream open end
40*b:* downstream open end
41: inner pipe (hollow member)
41A: upstream portion
41B: downstream portion
41*a:* upstream open end (upstream end portion)
41*b,* 41*c:* downstream open end (downstream end portion)
51: outer pipe (exhaust pipe)
51*a:* upstream open end (upstream open end of exhaust pipe)
52: outlet pipe (hollow member)
52A: upstream portion (upstream portion of exhaust pipe)
52*a:* upstream open end (upstream end)
52*b:* downstream open end (downstream end)
53: tail pipe (exhaust pipe)

53B: downstream portion (downstream portion of exhaust pipe)
53*b:* downstream open end (downstream open end of exhaust pipe)
61: outlet pipe (exhaust pipe)
61A: upstream portion (upstream portion of exhaust pipe)
61*a:* bore (upstream open end of exhaust pipe)
62: tail pipe (exhaust pipe)
62B: downstream portion (downstream portion of exhaust pipe)
62*b:* downstream open end (downstream open end of exhaust pipe)
63: partition plate (hollow member)
69: bottom half circular portion (hollow member)
70: upstream open end (upstream end)
71: downstream open end (downstream end)
89: outlet pipe (hollow member)
89*a:* upstream open end (upstream end)
89*b:* downstream open end (downstream end)
90: outer pipe (exhaust pipe)
90A: upstream portion (upstream portion of exhaust pipe)
90*a:* upstream open end (upstream open end of exhaust pipe)
91: tail pipe (exhaust pipe)
91B: downstream portion (downstream portion of exhaust pipe)
91*b:* downstream open end (downstream open end of exhaust pipe)

The invention claimed is:

1. An exhaust apparatus of an internal combustion engine, comprising:

a sound deadening device having an expansion chamber in which an exhaust gas discharged from the internal combustion engine is introduced to extend the exhaust gas flow and to mute exhaust gas sounds, and a resonance chamber adjacent to the expansion chamber to mute the exhaust gas sounds of a specific frequency;

an exhaust pipe having an upstream portion and a downstream portion positioned at an upstream side and a downstream side, respectively, in an exhaust flow direction of the exhaust gas, the upstream portion having an upstream open end connected with the expansion chamber of the sound deadening device, and the downstream portion having a downstream open end through which the exhaust gas discharged from the sound deadening device is discharged to an atmosphere; and a hollow member disposed in the exhaust pipe and having a downstream end forming an open end, and an upstream end forming an open end protruded outwardly from an inside of the exhaust pipe through the upstream open end of the exhaust pipe to be communicated with the resonance chamber and being located in a closed space surrounded by a wall portion of the sound deadening device defining the resonance chamber; and an axial length of the exhaust pipe and an axial length of the hollow member being set to match a specific frequency of the resonance chamber to a frequency of an air column resonance generated in the exhaust pipe.

2. An exhaust apparatus of an internal combustion engine as set forth in claim 1, in which the downstream end of the hollow member is positioned at the upstream side of a central portion of the exhaust pipe in a longitudinal direction of the exhaust pipe.

3. An exhaust apparatus of an internal combustion engine as set forth in claim 1, in which the exhaust pipe is constituted by a single tail pipe, an upstream portion of the single tail pipe being received in the sound deadening device, and the hollow member having an upstream portion supported by an inner peripheral portion of the wall portion of the resonance chamber, and a downstream portion having a circumferential portion partially supported by an inner peripheral portion of the exhaust pipe.

4. An exhaust apparatus of an internal combustion engine as set forth in claim 1, in which the exhaust pipe is constituted by an outer pipe provided in the sound deadening device, and a tail pipe connected to the outer pipe and extending toward a downstream side of the sound deadening device, and the hollow member is constituted by an outlet pipe provided in the outer pipe, and a downstream portion of the outlet pipe is connected with an upstream portion of the tail pipe, and is formed with at least one through-bore allowing an inside of the outlet pipe to be held in communication with an inside of the outer pipe.

5. An exhaust apparatus of an internal combustion engine as set forth in claim 4, in which the outer pipe and the outlet pipe are bent in the sound deadening device.

* * * * *